US011764483B2

(12) United States Patent
Lee et al.

(10) Patent No.: US 11,764,483 B2
(45) Date of Patent: Sep. 19, 2023

(54) ANTENNA APPARATUS

(71) Applicant: Samsung Electro-Mechanics Co., Ltd., Suwon-si (KR)

(72) Inventors: Won Cheol Lee, Suwon-si (KR); Jeong Ki Ryoo, Suwon-si (KR); Nam Ki Kim, Suwon-si (KR); Jae Min Keum, Suwon-si (KR); Dong Ok Ko, Suwon-si (KR); Shin Haeng Heo, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 321 days.

(21) Appl. No.: 16/914,824

(22) Filed: Jun. 29, 2020

(65) Prior Publication Data

US 2021/0242604 A1 Aug. 5, 2021

(30) Foreign Application Priority Data

Jan. 30, 2020 (KR) ..... 10-2020-0010763
May 27, 2020 (KR) ..... 10-2020-0063551

(51) Int. Cl.

| | |
|---|---|
| ***H01Q 1/38*** | (2006.01) |
| ***H01Q 21/06*** | (2006.01) |
| ***H01Q 9/04*** | (2006.01) |
| ***H01Q 5/364*** | (2015.01) |

(52) U.S. Cl.
CPC ..... *H01Q 21/065* (2013.01); *H01Q 5/364* (2015.01); *H01Q 9/0407* (2013.01)

(58) Field of Classification Search
CPC .... H01Q 21/065; H01Q 5/364; H01Q 9/0407; H01Q 5/385; H01Q 21/28; H01Q 1/38; H01Q 1/48
See application file for complete search history.

(56) References Cited

U.S. PATENT DOCUMENTS

| | | | |
|---|---|---|---|
| 6,642,898 | B2 | 11/2003 | Eason |
| 9,559,425 | B2 | 1/2017 | Zhu et al. |
| 10,283,867 | B2 | 5/2019 | Khan et al. |

(Continued)

FOREIGN PATENT DOCUMENTS

| | | | |
|---|---|---|---|
| JP | 05347510 A | * | 12/1993 |
| KR | 10-1766216 B1 | | 8/2017 |

OTHER PUBLICATIONS

Sharma, Devendra Kumar, et al., "Shared Aperture Dual Band Dual Polarization Microstrip Patch Antenna," *Microwave and Optical Technology Letters*, vol. 55, Issue 4, Apr. 2013 (pp. 917-922).

(Continued)

*Primary Examiner* — Dieu Hien T Duong
(74) *Attorney, Agent, or Firm* — NSIP Law

(57) ABSTRACT

An antenna apparatus includes a ground plane, a patch antenna pattern disposed on an upper surface of the ground plane, a feed via penetrating the ground plane and spaced apart from the patch antenna pattern, and a coiled feed pattern electrically connected to an upper end of the feed via, spaced apart from the patch antenna pattern, and configured to provide a feed path to the patch antenna pattern, wherein at least a portion of the coiled feed pattern is coiled, wherein the patch antenna pattern includes an aperture portion corresponding to the coiled feed pattern.

17 Claims, 24 Drawing Sheets

(56) References Cited

U.S. PATENT DOCUMENTS

2005/0140549 A1* 6/2005 Leelaratne ..... H01Q 9/0421
343/846

OTHER PUBLICATIONS

Lai, Hau Wah et al., "An L-Probe Fed Patch Antenna Loaded with Multiple Dielectric Layers", *2015 IEEE 4th Asia-Pacific Conference on Antennas and Propagation* (*APCAP*), 2015 (pp. 263-264).

* cited by examiner

ANTENNA APPARATUS

CROSS-REFERENCE TO RELATED APPLICATIONS

This application claims the benefit under USC 119(a) of Korean Patent Application Nos. 10-2020-0010763 filed on Jan. 30, 2020, and 10-2020-0063551 filed on May 27, 2020, in the Korean Intellectual Property Office, the entire disclosures of which are incorporated herein by reference for all purposes.

BACKGROUND

1. Field

The present disclosure relates to an antenna apparatus.

2. Description of the Background

Data traffic for mobile communications is increasing rapidly every year. Technological development is underway to support the transmission of such rapidly increased data in real time in wireless networks. For example, the contents of internet of things (IoT) based data, augmented reality (AR), virtual reality (VR), live VR/AR combined with SNS, autonomous navigation, applications such as Sync View (real-time video user transmissions using ultra-small cameras), and the like may require communications (e.g., 5G communications, mmWave communications, etc.) supporting the transmission and reception of large amounts of data.

Millimeter wave (mmWave) communications, including 5th generation (5G) communications, have been researched, and research into the commercialization/standardization of an antenna apparatus for smoothly realizing such communications is progressing.

Since radio frequency (RF) signals in high frequency bands (e.g., 24 GHz, 28 GHz, 36 GHz, 39 GHz, 60 GHz, etc.) are easily absorbed and lost in the course of the transmission thereof, the quality of communications may be dramatically reduced. Therefore, antennas for communications in high frequency bands may require different approaches from those of conventional antenna technology, and a separate approach may require further special technologies, such as implementing separate power amplifiers for securing antenna gain, integrating an antenna and radio frequency integrated circuit (RFIC), securing effective isotropic radiated power (EIRP), and the like.

The above information is presented as background information only to assist with an understanding of the present disclosure. No determination has been made, and no assertion is made, as to whether any of the above might be applicable as prior art with regard to the disclosure.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, an antenna apparatus includes a ground plane, a patch antenna pattern disposed on an upper surface of the ground plane, a feed via disposed to penetrate the ground plane while being spaced apart from the patch antenna pattern, and a coiled feed pattern electrically connected to an upper end of the feed via, spaced apart from the patch antenna pattern, and configured to provide a feed path to the patch antenna pattern, wherein at least a portion of the coiled feed pattern is coiled, wherein the patch antenna pattern comprises an aperture portion corresponding to the coiled feed pattern.

The patch antenna pattern may include a recessed shape in a portion in which the aperture portion is located.

The aperture portion may include an aperture pattern disposed below the patch antenna pattern and at least partially overlapping a recessed portion of the patch antenna pattern in a vertical direction.

The aperture portion may include a plurality of aperture vias, each one end of which is electrically connected to a first patch antenna pattern of the patch antenna pattern, and an aperture pattern electrically connecting each other ends of the plurality of aperture vias.

The aperture portion may include an aperture pattern disposed below the patch antenna pattern, and the at least a portion of the coiled feed pattern may be disposed on a level between the aperture pattern and the patch antenna pattern.

The patch antenna pattern may include a polygonal shape, and the aperture portion may include a plurality of aperture portions respectively arranged on a plurality of sides of the polygonal shape.

The coiled feed pattern may include a first coiled feed pattern having one end electrically connected to the feed via, an inductive via having one end electrically connected to another end of the first coiled feed pattern, and a second coiled feed pattern having one end electrically connected to another end of the inductive via and disposed to at least partially overlap the first coiled feed pattern in a vertical direction.

A portion of the second coiled feed pattern may extend in different directions from one end of a coiled portion of the second coiled feed pattern.

The patch antenna pattern may include a first patch antenna pattern having the aperture portion, and a second patch antenna pattern disposed on the first patch antenna pattern at least partially overlapping the first patch antenna pattern in a vertical direction, and the feed via may include a first feed via electrically connected to the coiled feed pattern, and a second feed via spaced apart from the first feed via, penetrating the first patch antenna pattern, and electrically connected to the second patch antenna pattern.

The second feed via may include a plurality of second feed vias respectively biased in different directions from a center of the second patch antenna pattern, the plurality of second feed vias may have portions extending parallel to the first and second patch antenna patterns between the first and second patch antenna patterns in different directions, and lengths of the extending portions of the plurality of second feed vias between the first and second patch antenna patterns may be different.

The antenna apparatus may further include a plurality of ground vias electrically connecting between the first patch antenna pattern and the ground plane, respectively.

In another general aspect, an antenna apparatus includes a dielectric layer, a first patch antenna pattern disposed on an upper surface of the dielectric layer, a first feed via penetrating the dielectric layer by at least a portion of a thickness of the dielectric layer and spaced apart from the first patch antenna pattern, and a coiled feed pattern electrically connected to an upper end of the first feed via, spaced apart from the first patch antenna pattern, and configured to provide a feed path to the first patch antenna pattern, wherein at least a portion of the coiled feed pattern is coiled, wherein a portion of the coiled feed pattern extends in different directions from one end of a coiled portion of the coiled feed pattern.

A coiling axis of the coiled portion may be biased from the first feed via to the first patch antenna pattern.

The coiled portion may include n and a half turns, where n is a natural number.

The coiled feed pattern may include a first coiled feed pattern having one end electrically connected to the first feed via, an inductive via having one end electrically connected to another end of the first coiled feed pattern, and a second coiled feed pattern having one end electrically connected to another end of the inductive via and at least partially overlapping the first coiled feed pattern in a vertical direction, wherein a portion of the second coiled feed pattern may extend in different directions from one end of a coiled portion of the second coiled feed pattern.

The coiled feed pattern may be disposed not to overlap the first patch antenna pattern in a vertical direction.

The antenna apparatus may further include an extended patch antenna pattern at least partially overlapping the coiled feed pattern in the vertical direction.

In another general aspect, an antenna apparatus includes a dielectric layer, a first patch antenna pattern disposed on an upper surface of the dielectric layer, a first feed via penetrating the dielectric layer by at least a portion of a thickness of the dielectric layer and spaced apart from the first patch antenna pattern, a coiled feed pattern electrically connected to an upper end of the first feed via, spaced apart from the first patch antenna pattern, and configured to provide a feed path to the first patch antenna pattern, wherein at least a portion of the coiled feed pattern is coiled, an extended patch antenna pattern at least partially overlapping the coiled feed pattern in a vertical direction, and a second patch antenna pattern disposed on the first patch antenna pattern and at least partially overlapping the first patch antenna pattern in the vertical direction.

A coiling axis of a coiled portion of the coiled feed pattern may be biased from the first feed via to the first patch antenna pattern.

The second patch antenna pattern may have a polygonal shape, the extended patch antenna pattern may include a plurality of extended patch antenna patterns respectively arranged on a plurality of sides of the polygonal shape, and two or more of the plurality of extended patch antenna patterns may have different sizes.

The first feed via may include a plurality of first feed vias spaced apart from each other, the coiled feed pattern may include a plurality of coiled feed patterns electrically connected to upper ends of the plurality of first feed vias, respectively, and one extended patch antenna pattern, among the two or more of the plurality of extended patch antenna patterns, may be disposed not to overlap at least a portion of one first feed via, among the plurality of first feed vias, in the vertical direction, and another extended patch antenna pattern, among the two or more of the plurality of extended patch antenna patterns, may be disposed to further overlap another first feed via, among the plurality of first feed vias, in the vertical direction.

The antenna apparatus may further include a plurality of second feed vias spaced apart from the first feed via, penetrating the first patch antenna pattern, and electrically connected to the second patch antenna pattern, respectively, wherein the plurality of second feed vias may have portions extending parallel to the first and second patch antenna patterns between the first and second patch antenna patterns in different directions, and wherein lengths of the extending portions of the plurality of second feed vias between the first and second patch antenna patterns may be different.

The antenna apparatus may further include a second feed via spaced apart from the first feed via, penetrating the first patch antenna pattern, and electrically connected to the second patch antenna pattern, and a plurality of ground vias extending from the first patch antenna pattern, respectively, in a downward direction.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1A:
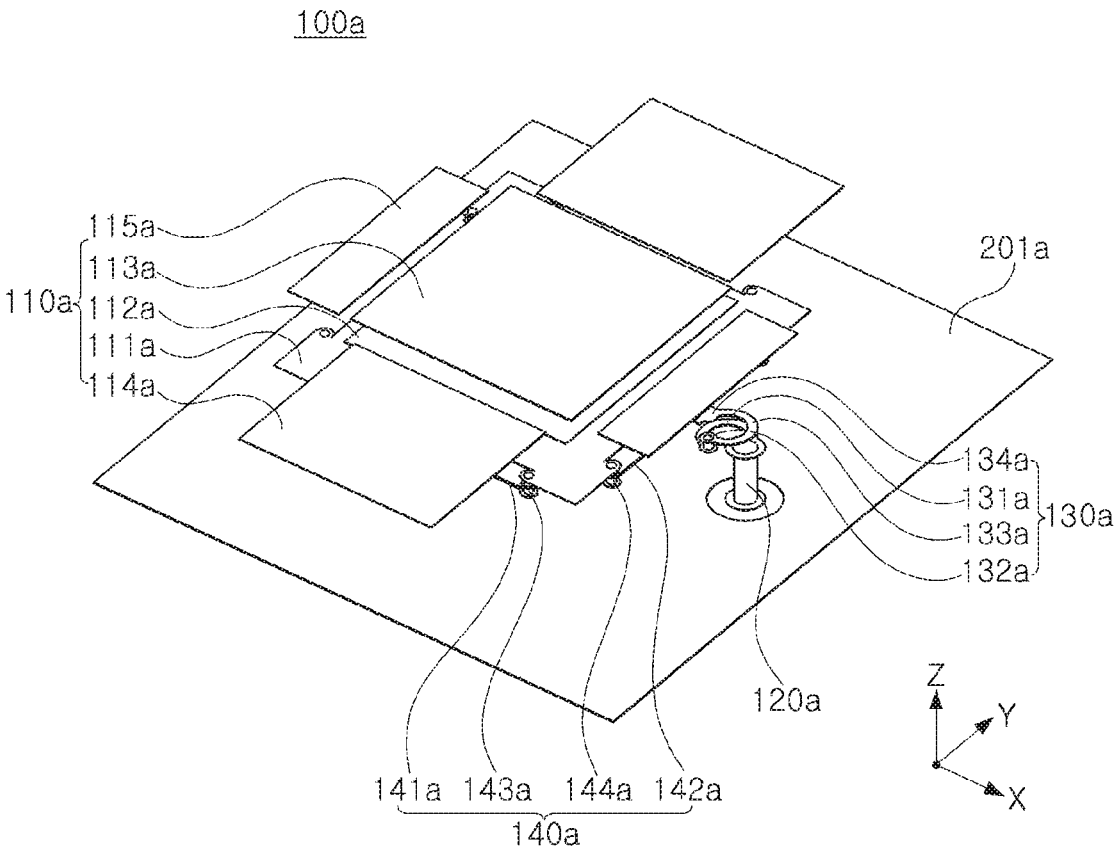
FIGS. 1A to 1D are perspective views illustrating antenna apparatuses according to embodiments of the present disclosure.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of this disclosure. For example, the sequences of operations described herein are merely examples, and are not limited to those set forth herein, but may be changed as will be apparent after an understanding of this disclosure, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of this disclosure.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween. As used herein "portion" of an element may include the whole element or less than the whole element.

As used herein, the term "and/or" includes any one and any combination of any two or more of the associated listed items; likewise, "at least one of" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms, such as "above," "upper," "below," "lower," and the like, may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above," or "upper" relative to another element would then be "below," or "lower" relative to the other element. Thus, the term "above" encompasses both the above and below orientations depending on the spatial orientation of the device. The device may be also be oriented in other ways (rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

The features of the examples described herein may be combined in various ways as will be apparent after an understanding of this disclosure. Further, although the examples described herein have a variety of configurations, other configurations are possible as will be apparent after an understanding of this disclosure.

Herein, it is noted that use of the term "may" with respect to an example, for example, as to what an example may include or implement, means that at least one example exists in which such a feature is included or implemented while all examples are not limited thereto.

An aspect of the present disclosure is to provide an antenna apparatus.

Figure 3A:
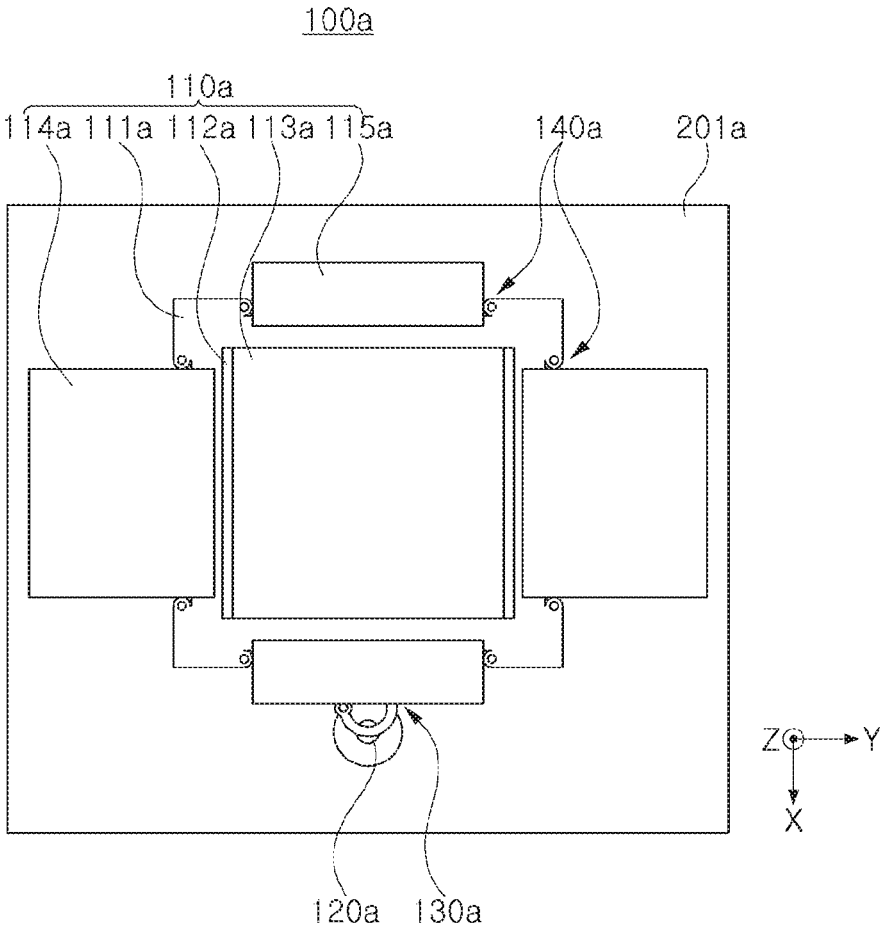
FIG. 3A is a plan view illustrating an antenna apparatus according to an embodiment of the present disclosure.

FIG. 1A is a perspective view illustrating an antenna apparatus according to an embodiment of the present disclosure, and FIG. 3A is a plan view illustrating an antenna apparatus according to an embodiment of the present disclosure.

Referring to FIG. 1A and FIG. 3A, an antenna apparatus 100*a* according to an embodiment of the present disclosure may include a patch antenna pattern 110*a*, a first feed via 120*a*, and a coiled feed pattern 130*a*, and may further include at least one of an aperture portion 140*a* and a ground plane 201*a*.

Referring to FIG. 1A and FIG. 3A, the patch antenna pattern 110*a* may include at least one of a first patch antenna pattern 111*a*, a second patch antenna pattern 112*a*, a third patch antenna pattern 113*a*, and a plurality of extended patch antenna patterns 114*a* and 115*a*.

The patch antenna pattern 110*a* may be disposed on an upper surface of the ground plane 201*a*. The first patch antenna pattern 111*a* may be configured to have a first resonant frequency, and may remotely transmit or remotely receive a radio frequency (RF) signal close to the first resonant frequency.

When the RF signal is remotely transmitted and received, most of a surface current corresponding to the RF signal may flow through an upper surface and a lower surface of the first patch antenna pattern 111*a*. The surface current may form an electric field in a first horizontal direction that may be the same as a direction of the surface current, and may form a magnetic field in a second horizontal direction, perpendicular to the direction of the surface current. Most of the RF signals may propagate through air or dielectric layers in a vertical direction (e.g., a z direction), perpendicular to the first and second horizontal directions.

Therefore, a radiation pattern of the first patch antenna pattern 111*a* may be intensively formed in a normal direction (e.g., the z direction) of the upper and lower surfaces of the first patch antenna pattern 111*a*. Gain of the first patch antenna pattern 111*a* may be improved, as concentration of the radiation pattern of the first patch antenna pattern 111*a* increases.

Since the ground plane 201*a* may reflect the RF signal to support the concentration of the radiation pattern of the first patch antenna pattern 111*a*, the gain of the first patch antenna pattern 111*a* may further increase, and may support formation of impedance corresponding to the first resonant frequency of the first patch antenna pattern 111*a*.

The surface current flowing in the first patch antenna pattern 111*a* may be formed based on a feed path provided to the first patch antenna pattern 111*a*. The feed path may extend from the first patch antenna pattern 111*a* to an integrated circuit (IC), and may be a transmission path of the RF signal. The IC may perform at least one of amplification, frequency conversion, phase control, and filtering on a received RF signal, or may perform at least one of amplification, frequency conversion, phase control, and filtering on the received RF signal, to generate an RF signal to be transmitted.

The first feed via 120*a* may provide a feed path to the first patch antenna pattern 111*a*. The first feed via 120*a* may be disposed to penetrate the ground plane 201*a* and/or a dielectric layer, and may be spaced apart from the patch antenna pattern 110*a*.

For example, the first feed via 120*a* may be disposed so as not to contact the patch antenna pattern 110*a*. Therefore, since a portion of the first feed via 120*a*, close to the first patch antenna pattern 111*a*, may be designed more freely, additional impedance may be provided by the first patch antenna pattern 111*a*.

At least one additional resonant frequency, corresponding to the additional impedance, may widen a bandwidth of the first patch antenna pattern 111*a* to be passed. A width of the bandwidth may be determined, based on appropriateness of a difference in frequency between the at least one additional resonant frequency and the first resonant frequency, and the number of additional resonance frequencies, close to the first resonant frequency, among the at least one additional resonance frequencies.

As a degree of freedom in design of the portion of the first feed via 120*a*, close to the first patch antenna pattern 111*a*, increases, the appropriateness and/or number of the at least one additional resonant frequency may be improved more efficiently.

Therefore, the first feed via 120*a* may provide a non-contact feed path to the first patch antenna pattern 111*a*, to improve the bandwidth of the first patch antenna pattern 111*a* more efficiently.

The coiled feed pattern 130*a* may be electrically connected to an upper end of the first feed via 120*a*, and may be spaced apart from the patch antenna pattern 110*a*.

For example, the first feed via 120*a* may use a relatively high degree of freedom in design of the portion of the first feed via 120*a*, close to the first patch antenna pattern 111*a*, to have an arrangement space of the coiled feed pattern 130*a*.

In addition, the coiled feed pattern 130*a* may provide a feed path to the first patch antenna pattern 111*a*, and at least a portion thereof may have a coiled portion.

Since the coiled feed pattern 130*a* is used as the feed path, a coiling current, corresponding to an RF signal transmitted through the coiled feed pattern 130*a*, may flow through the coiled feed pattern 130*a*. The coiling current may rotate corresponding to a coiling direction of the coiled portion of the coiled feed pattern 130*a*.

Therefore, since self-inductance of the coiled feed pattern 130*a* may be boosted, the coiled feed pattern 130*a* may have a relatively large inductance.

The coiled feed pattern 130*a* may provide the inductance to the first patch antenna pattern 111*a*, and the first patch antenna pattern 111*a* may have a wider bandwidth, based on an additional resonant frequency corresponding to the inductance.

The coiled feed pattern 130*a* may provide a feed path to the patch antenna pattern 110*a* by electromagnetic coupling with the patch antenna pattern 110*a*.

As concentration of the electromagnetic coupling increases, energy loss of the electromagnetic coupling may be reduced, and gain of the patch antenna pattern 110*a* may be improved.

First, the aperture portion 140*a* may be provided in the patch antenna pattern 110*a*, to correspond to the coiled feed pattern 130*a*.

Since the aperture portion 140*a* may provide a rotation path of the surface current flowing through the first patch antenna pattern 111*a*, inductance that may be used to match impedance of the feed path of the first patch antenna pattern 111*a* may be provided to the first patch antenna pattern 111*a*.

In addition, since electromagnetic coupling between the aperture portion 140*a* and the coiled feed pattern 130*a* may improve mutual inductance, efficiency for matching the impedance of the feed path of the first patch antenna pattern 111*a* may be further improved.

Therefore, since the antenna apparatus 100*a* according to an embodiment of the present disclosure may increase the concentration of the electromagnetic coupling of the coiled feed pattern 130*a* with the patch antenna pattern 110*a*, the gain of the patch antenna pattern 110*a* may be further improved.

For example, the aperture portion 140*a* may include at least one of a plurality of aperture patterns 141*a* and 142*a* and a plurality of aperture vias 143*a* and 144*a*.

Second, at least a portion of the coiled feed pattern 130*a* may extend in different directions from one end of a coiled portion of the coiled feed pattern 130*a*. For example, the coiled feed pattern 130*a* may include an extension portion 134*a*.

As the number of a plurality of extending directions of the extension portion 134*a* is large, or an angle between the plurality of extending directions of the extension portion 134*a* is large, energy corresponding to the RF signal in the coiled feed pattern 130*a* may be further focused on the extension portion 134*a*.

Since the coiled feed pattern 130*a* may include the extension portion 134*a* on which energy is concentrated, the first patch antenna pattern 111*a* may use the extension portion 134*a* as a core point for matching the impedance of the feed path. Therefore, the extension portion 134*a* may further improve efficiency for matching the impedance of the feed path of the first patch antenna pattern 111*a*.

Therefore, since the antenna apparatus 100*a* according to an embodiment of the present disclosure may increase the concentration of the electromagnetic coupling of the coiled feed pattern 130*a* with the patch antenna pattern 110*a*, the gain of the patch antenna pattern 110*a* may be further improved.

For example, the coiled feed pattern 130*a* may include at least one of a first coiled feed pattern 131*a*, an inductive via 132*a*, and a second coiled feed pattern 133*a*. The second coiled feed pattern 133*a* may include the extension portion 134*a*.

Third, at least a portion of at least one extended patch antenna pattern, among the plurality of extended patch antenna patterns 114*a* and 115*a*, may be disposed on the coiled feed pattern 130*a*, and may be disposed to overlap the coiled feed pattern 130*a* in the vertical direction (for example, the z direction). The second patch antenna pattern 112*a* may be disposed on the first patch antenna pattern 111*a*, and may be disposed such that at least a portion of the second patch antenna pattern 112*a* overlaps the first patch antenna pattern 111*a* in the vertical direction (e.g., the z direction).

Since the at least one extended patch antenna pattern, among the plurality of extended patch antenna patterns 114*a* and 115*a*, is electromagnetically coupled to the coiled feed pattern 130*a*, a portion of energy, corresponding to the RF signal, may be provided to the at least one extended patch antenna pattern, among the plurality of extended patch antenna patterns 114*a* and 115*a*, and may be provided to the first patch antenna pattern 111*a* through the second patch antenna pattern 112*a*.

For example, since a feed path of the coiled feed pattern 130*a* may be more diversified, efficiency for electricity feeding the coiled feed pattern 130*a* may be further improved.

Therefore, since the antenna apparatus 100*a* according to an embodiment of the present disclosure may increase the concentration of the electromagnetic coupling of the coiled feed pattern 130*a* with the patch antenna pattern 110*a*, the gain of the patch antenna pattern 110*a* may be further improved.

Figure 1B:
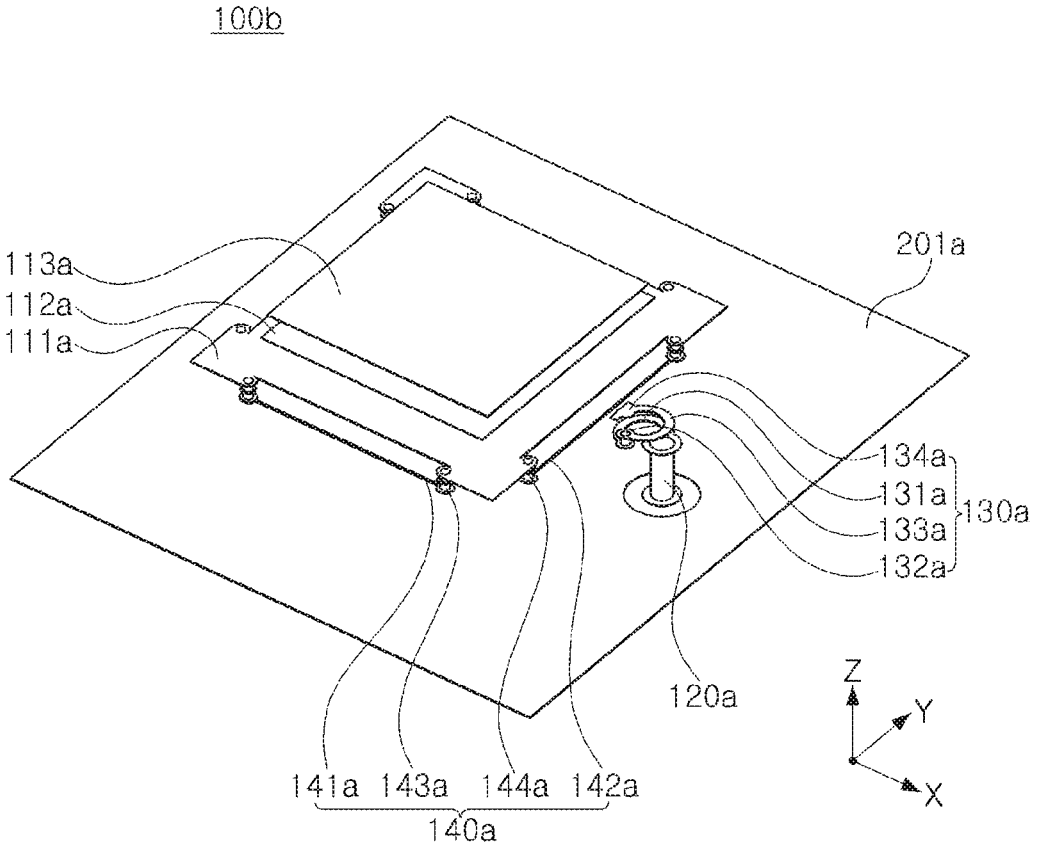
Figure 1C:
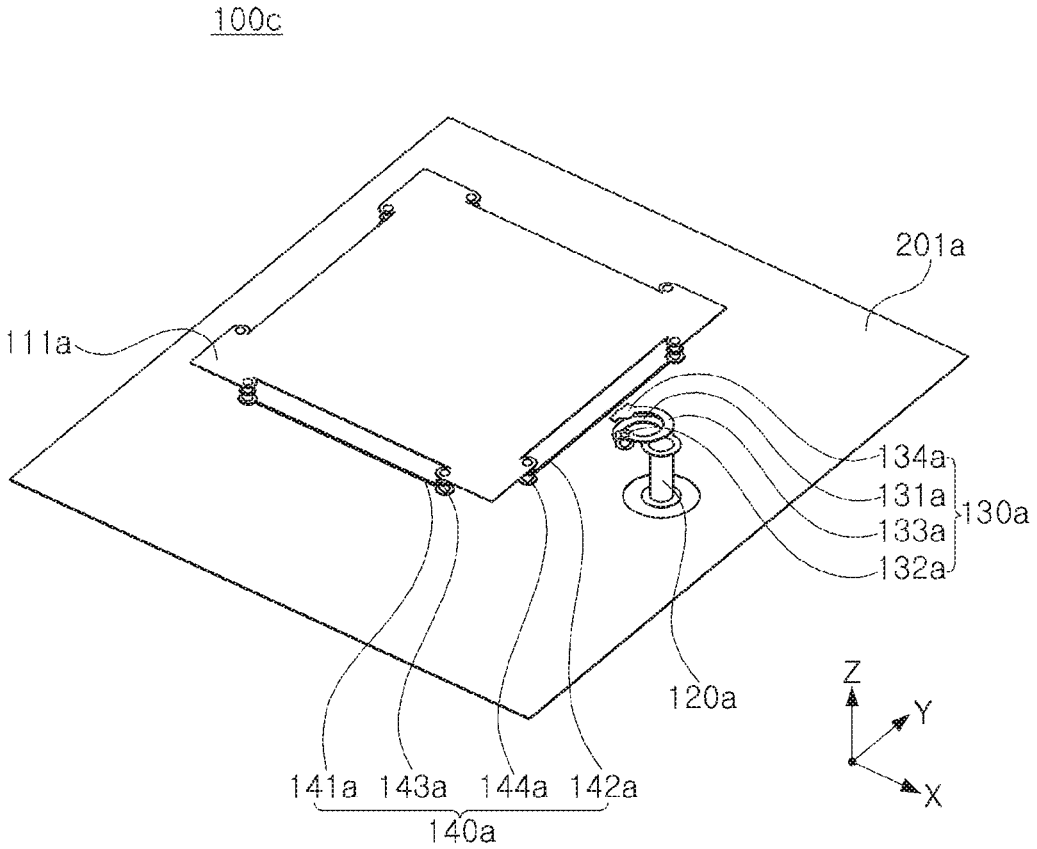
Figure 1D:
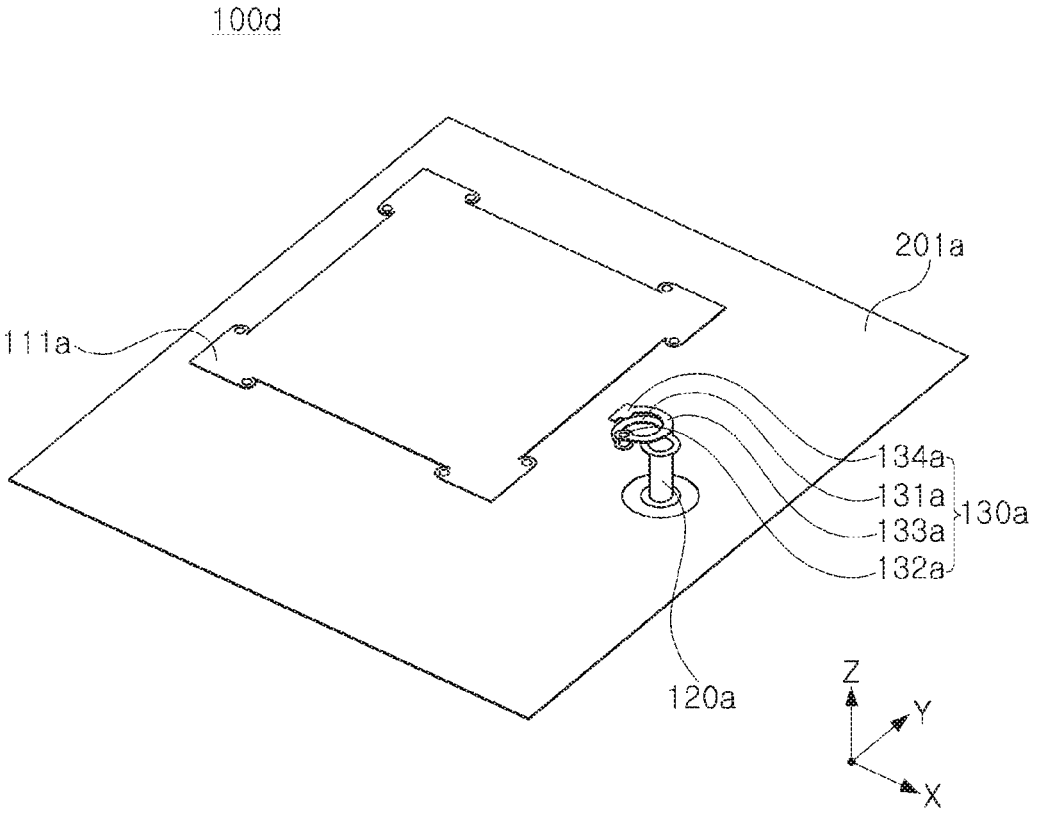

FIGS. 1B to 1D are perspective views illustrating antenna apparatuses according to embodiments of the present disclosure.

Referring to FIG. 1B, an antenna apparatus 100*b* according to an embodiment of the present disclosure may have a structure in which a plurality of extended patch antenna patterns are omitted, and may have a structure in which a feed path is efficiently provided to at least one patch antenna pattern, among first, second, and third patch antenna patterns 111*a*, 112*a*, and 113*a*, through a first feed via 120*a*, a coiled feed pattern 130*a*, and an aperture portion 140*a*.

Referring to FIG. 10, an antenna apparatus 100*c* according to an embodiment of the present disclosure may have a structure in which second and third patch antenna patterns are omitted, and may have a structure in which a feed path is efficiently provided to a first patch antenna pattern 111*a* through a first feed via 120*a*, a coiled feed pattern 130*a*, and an aperture portion 140*a*.

Referring to FIG. 1D, an antenna apparatus 100*d* may have a structure in which an aperture portion is omitted, and may have a structure in which a feed path is efficiently provided to a first patch antenna pattern 111*a* through a first feed via 120*a* and a coiled feed pattern 130*a*.

Figure 2A:
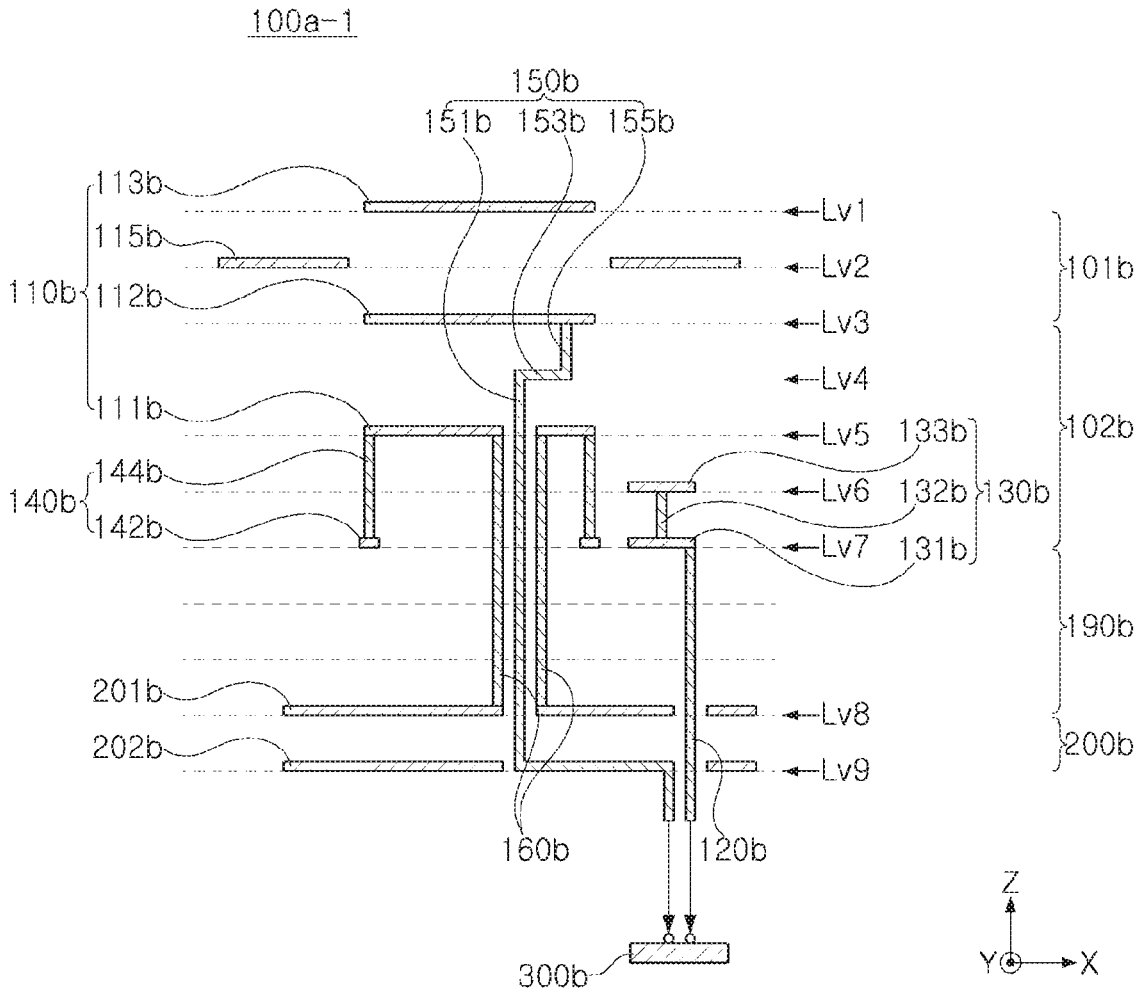
FIGS. 2A to 2C are cross-sectional views illustrating antenna apparatuses according to embodiments of the present disclosure.
Figure 2B:
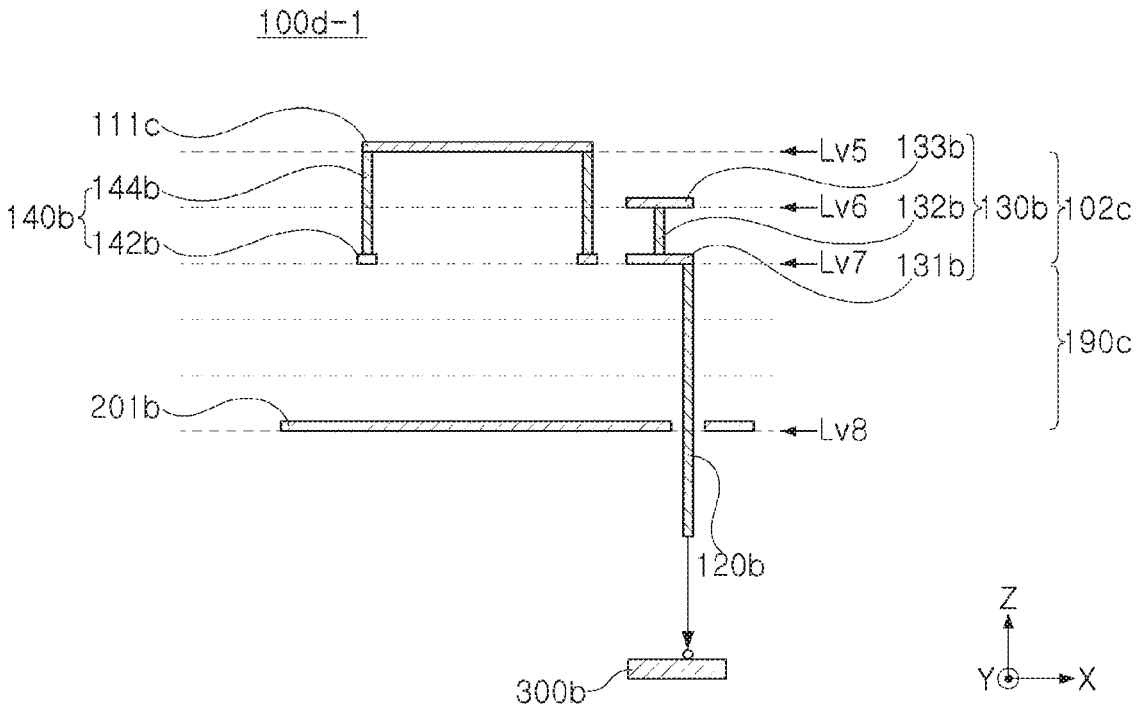
Figure 2C:
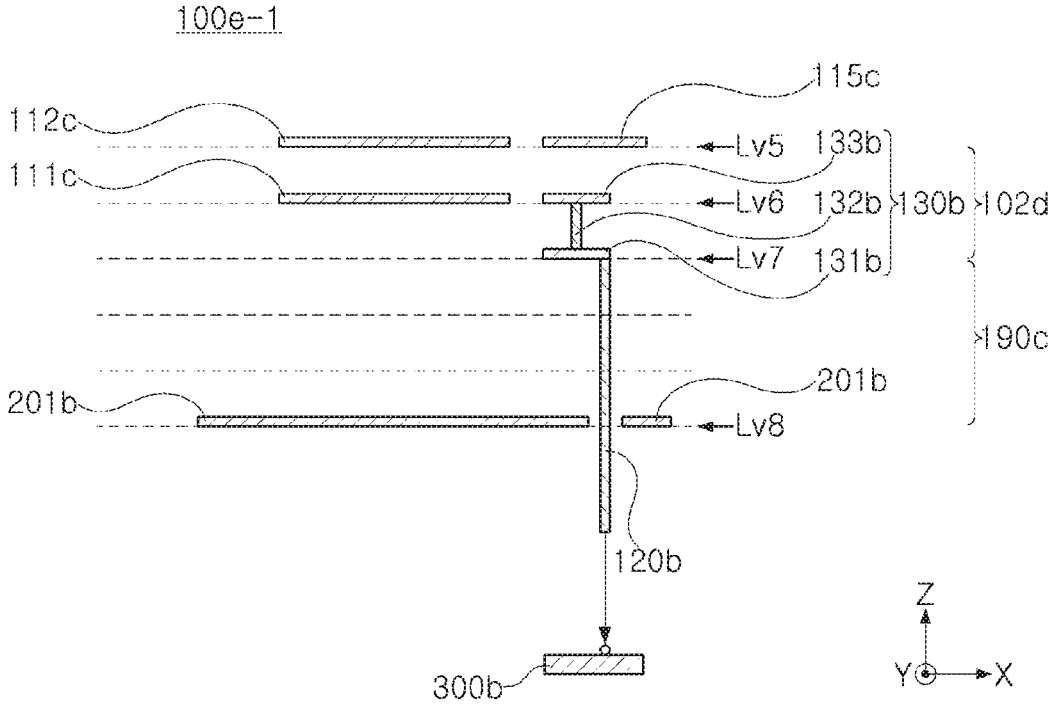

FIGS. 2A to 2C are cross-sectional views illustrating antenna apparatuses according to embodiments of the present disclosure.

Referring to FIG. 2A, an antenna apparatus 100*a*-1 according to an embodiment of the present disclosure may include a patch antenna pattern 110*b*, a first feed via 120*b*, and a coiled feed pattern 130*b*, and further includes an aperture portion 140*b*, a dielectric layer 190*b*, and first and second ground planes 201*b* and 202*b*.

The antenna apparatus 100*a*-1 according to the embodiment of the present disclosure may include a first region 101*b* and a second region 102*b* on an upper surface of the dielectric layer 190*b*.

The first region 101*b* may include a first layer Lv1, a second layer Lv2, and a third layer Lv3, and the second region 102*b* may include a fourth layer Lv4, a fifth layer Lv5, a sixth layer Lv6, and a seventh layer Lv7.

A plurality of insulating layers may be arranged between the first layer Lv1, the second layer Lv2, the third layer Lv3, the fourth layer Lv4, the fifth layer Lv5, the sixth layer Lv6, and the seventh layer Lv7, respectively, and a conductive material may be partially arranged on an upper surface and/or a lower surface of the first layer Lv1, the second layer Lv2, the third layer Lv3, the fourth layer Lv4, the fifth layer Lv5, the sixth layer Lv6, and the seventh layer Lv7, according to a predesigned pattern, respectively. In this case, the predesigned pattern may be implemented as a patch antenna pattern or a coiled feed pattern.

A via may extend in the vertical direction (e.g., the z direction) to penetrate the plurality of insulating layers, and may provide an electrical connection path between the first layer Lv1, the second layer Lv2, the third layer Lv3, the fourth layer Lv4, the fifth layer Lv5, the sixth layer Lv6, and the seventh layer Lv7, respectively.

For example, the via may be formed by filling the conductive material in a state from which a portion of the plurality of insulating layers is removed, and may be formed according to a method of forming the via in a conventional printed circuit board (PCB).

A third patch antenna pattern 113*b* may be disposed on the first layer Lv1.

An extended patch antenna pattern 115*b* may be disposed on the second layer Lv2.

A second patch antenna pattern 112*b* may be disposed on the third layer Lv3.

A first patch antenna pattern 111*b* may be disposed on the fifth layer Lv5, and may overlap the second and third patch antenna patterns 112*b* and 113*b* in the vertical direction.

The coiled feed pattern 130*b* may be disposed on the sixth and seventh layers Lv6 and Lv7, may overlap the extended patch antenna pattern 115*b* in the vertical direction, and may be disposed so as not to overlap the first patch antenna pattern 111*b* in the vertical direction.

For example, a second coiled feed pattern 133*b* may be disposed on the sixth layer Lv6, a first coiled feed pattern 131*b* may be disposed on the seventh layer Lv7, and an inductive via 132*b* may be disposed between the sixth and seventh layers Lv6 and Lv7.

The aperture portion 140*b* may be disposed in the fifth to seventh layers Lv5, Lv6, and Lv7, may include an aperture pattern 142*b* disposed on a lower level than the first patch antenna pattern 111*b*, and may further include an aperture via 144*b* electrically connecting the aperture pattern 142*b* and the first patch antenna pattern 111*b*.

The second coiled feed pattern 133*b*, which may be at least a portion of the coiled feed pattern 130*b*, may be disposed on the sixth layer Lv6, which may be a level between the aperture pattern 142*b* and the first patch antenna pattern 111*b*.

Therefore, mutual inductance between the coiled feed pattern 130*b* and the aperture portion 140*b* may further increase, and efficiency for matching the impedance of a feed path of the first patch antenna pattern 111*b* may be further improved.

The first feed via 120*b* may be disposed to penetrate the dielectric layer 190*b* by at least a portion of a thickness of the dielectric layer 190*b*, and may be electrically connected to an IC 300*b*.

A connection member 200*b* may be disposed below the dielectric layer 190*b*, may include the first and second ground planes 201*b* and 202*b*, and may provide an arrangement space of the IC 300*b*.

The first and second ground planes 201*b* and 202*b* may be arranged on eighth and ninth layers Lv8 and Lv9, respectively, and may improve a degree of electromagnetic isolation between the patch antenna pattern 110*b* and the IC 300*b*.

The antenna apparatus 100*a*-1 according to an embodiment of the present disclosure may further include a second feed via 150*b* disposed to be spaced apart from the first feed via 120*b*, penetrate the first patch antenna pattern 111*b*, and be electrically connected to the second patch antenna pattern 112*b*.

The second feed via 150*b* may provide a feed path of the second patch antenna pattern 112*b* to the second patch antenna pattern 112*b*, and may be used as a transmission path of a second RF signal.

The second patch antenna pattern 112*b* may be configured to have a second resonant frequency, different from a first resonant frequency, and the second RF signal may have a second frequency, different from a first frequency of an RF signal remotely transmitted to and remotely received from the first patch antenna pattern 111*b*.

For example, when the second frequency is higher than the first frequency, a size of the second patch antenna pattern 112*b* may be smaller than a size of the first patch antenna pattern 111*b*.

For example, the antenna apparatus 100*a*-1 according to an embodiment of the present disclosure may have a plurality of different frequency bands, depending on a design.

In view of the second patch antenna pattern 112*b*, the first patch antenna pattern 111*b* may be used as a ground plane for the second frequency.

A scattering phenomenon of electric and/or magnetic fields due to a fringing phenomenon of the ground plane may be reduced by the aperture portion 140*b*.

For example, since the first patch antenna pattern 111*b* having the aperture portion 140*b* may support concentration of a radiation pattern of the second patch antenna pattern 112*b* more efficiently, gain of the second patch antenna pattern 112*b* may be further improved. In this case, formation of impedance corresponding to the second resonant frequency of the second patch antenna pattern 112*b* may be more efficiently supported.

For example, the second feed via 150*b* may include at least one of a 2-1-th electricity feed portion 151*b*, a 2-2-th electricity feed portion 153*b*, and a 2-3-th electricity feed portion 155*b*.

The antenna apparatus 100*a*-1 according to an embodiment of the present disclosure may further include a plurality of ground vias 160*b* electrically connecting the first patch antenna pattern 111*b* and the first ground plane 201*b*.

Therefore, the second feed via 150*b* may further reduce electromagnetic interference of the second feed via 150*b* received from an external source based on a first RF signal, and gain of each of the first and second patch antenna patterns 111*b* and 112*b* may be further improved.

Referring to FIG. 2B, an antenna apparatus 100*d*-1 according to an embodiment of the present disclosure may have a structure in which a second region 102*c* from which second and third patch antenna patterns, an extended patch antenna pattern, and a second feed via are omitted, is disposed on an upper surface of a dielectric layer 190*c*, and may have a structure in which a feed path is efficiently provided to a first patch antenna pattern 111*c* through a first feed via 120*b*, a coiled feed pattern 130*b*, and an aperture 140*b*.

Referring to FIG. 2C, an antenna apparatus 100*e*-1 according to the embodiment of the present disclosure may have a structure in which a second region 102*d* from which a third patch antenna pattern and a second feed via are omitted, is disposed on an upper surface of a dielectric layer 190*c*, and may have a structure in which a feed path is provided to a first patch antenna pattern 111*c* through a first feed via 120*b* and a coiled feed pattern 130*b*, and a sub-feed path is provided to the first patch antenna pattern 111*c* through an extended patch antenna pattern 115*c* and a second patch antenna pattern 112*c*.

Figure 3B:
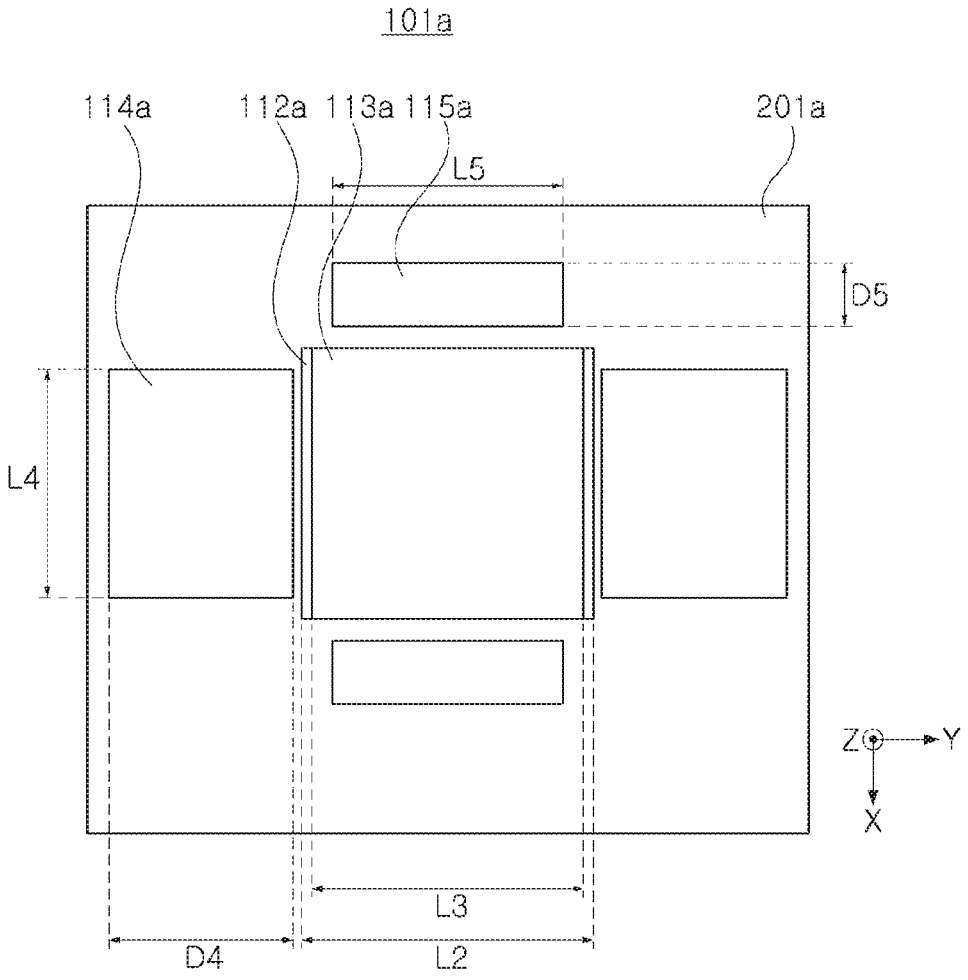
FIG. 3B is a plan view illustrating a first region of an antenna apparatus according to an embodiment of the present disclosure.

FIG. 3B is a plan view illustrating a first region of an antenna apparatus according to an embodiment of the present disclosure.

Referring to FIG. 3B, a first region 101*a* of an antenna apparatus according to an embodiment of the present disclosure may have a structure in which a second patch antenna pattern 112*a*, a third patch antenna pattern 113*a*, and a plurality of extended patch antenna patterns 114*a* and 115*a* are arranged on a ground plane 201*a*.

The second and third patch antenna patterns 112*a* and 113*a* may have a polygonal shape, and a side length (L2) of the second patch antenna pattern 112*a* may be slightly longer than a side length (L3) of the third patch antenna pattern 113*a*, and the side length (L3) of the third patch antenna pattern 113*a* may be slightly longer than a long side length (L4 or L5) of the plurality of extended patch antenna patterns 114*a* and 115*a*.

The plurality of extended patch antenna patterns 114*a* and 115*a* may be disposed on a plurality of sides of polygonal shapes of the second and third patch antenna patterns 112*a* and 113*a*, respectively, and short side lengths (D4 and D5) of the plurality of extended patch antenna patterns 114*a* and 115*a* may be different from each other.

For example, a size of an antenna apparatus according to an embodiment of the present disclosure in the x direction may be entirely more compressed, compared to a size of an antenna apparatus according to an embodiment of the present disclosure in the y direction. Therefore, since electromagnetic interference robustness of a plurality of antenna apparatuses for each other, according to arrangement of the plurality of antenna apparatuses according to an embodiment of the present disclosure in the y direction, may be further improved, the plurality of antenna apparatuses according to the embodiment of the present disclosure may be more efficiently arranged in the y direction, and efficiency in arrangement of an electronic device (e.g., a smartphone) having a relatively small arrangement space may be improved.

Figure 3C:
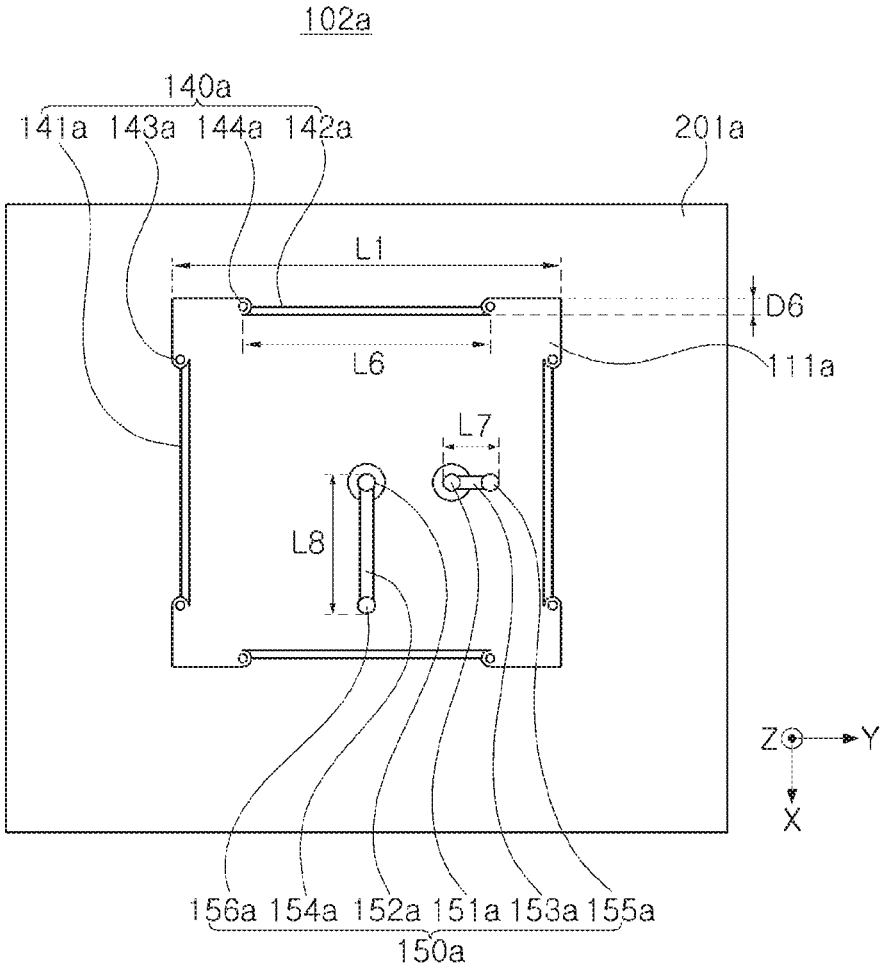
FIG. 3C is a plan view illustrating a second region of an antenna apparatus according to an embodiment of the present disclosure.

FIG. 3C is a plan view illustrating a second region of an antenna apparatus according to an embodiment of the present disclosure.

Referring to FIG. 3C, a second region 102*a* of an antenna apparatus according to an embodiment of the present disclosure may include at least one of a first patch antenna pattern 111*a*, an aperture portion 140*a*, and a plurality of second feed vias 150*a*.

The first patch antenna pattern 111*a* may have a polygonal shape, and a side length (L1) of the first patch antenna pattern 111*a* may be longer than a side length of a second or third patch antenna pattern. The aperture portion 140*a* may be provided as a plurality of aperture portions respectively disposed on a plurality of sides of the polygonal shape.

The first patch antenna pattern 111*a* may have a recessed portion in a position in which the aperture portion 140*a* is located. Therefore, a ratio of vertical components in an electric field and/or a magnetic field, based on a surface current flowing through the aperture portion 140*a*, may increase.

The vertical components may be used as an electricity feed impedance matching design element of the first patch antenna pattern 111*a*, and may be determined based on a length (L6) and a depth (D6) of the recessed portion of the first patch antenna pattern 111*a*.

Therefore, the first patch antenna pattern 111*a* may have the recessed portion in the position in which the aperture portion 140*a* is located, and thus may be electricity fed more efficiently.

The recessed portion of the first patch antenna pattern 111*a* may overlap aperture patterns 141*a* and 142*a* in the vertical direction. Since positions of the aperture patterns 141*a* and 142*a* may affect the vertical components, the aperture portion 140*a* may be designed more efficiently.

A plurality of 2-3-th electricity feed portions 155*a* and 156*a* of the plurality of second feed vias 150*a* may be respectively biased in different directions from a center of the second patch antenna pattern, respectively.

A plurality of 2-2-th electricity feed portions 153*a* and 154*a* may extend from the plurality of 2-3-th electricity feed portions 155*a* and 156*a* parallel to the first patch antenna pattern 111*a* in different directions. 2-1-th electricity feed portions 151*a* and 152*a* may extend from the plurality of 2-2-th electricity feed portions 153*a* and 154*a* in a z direction.

In this case, a plurality of extension lengths (L7 and L8) of the plurality of 2-2-th electricity feed portions 153*a* and 154*a* may be different from each other.

Therefore, an antenna apparatus according to an embodiment of the present disclosure may have a more compressive size in the x direction than a size in the y direction. Therefore, since electromagnetic interference robustness of a plurality of antenna apparatuses for each other, according to arrangement of the plurality of antenna apparatuses according to an embodiment of the present disclosure in the y direction, may be further improved, the plurality of antenna apparatuses according to the embodiment of the present disclosure may be more efficiently arranged in the y direction, and efficiency in arrangement of an electronic device (e.g., a smartphone) having a relatively small arrangement space may be improved.

Figure 3D:
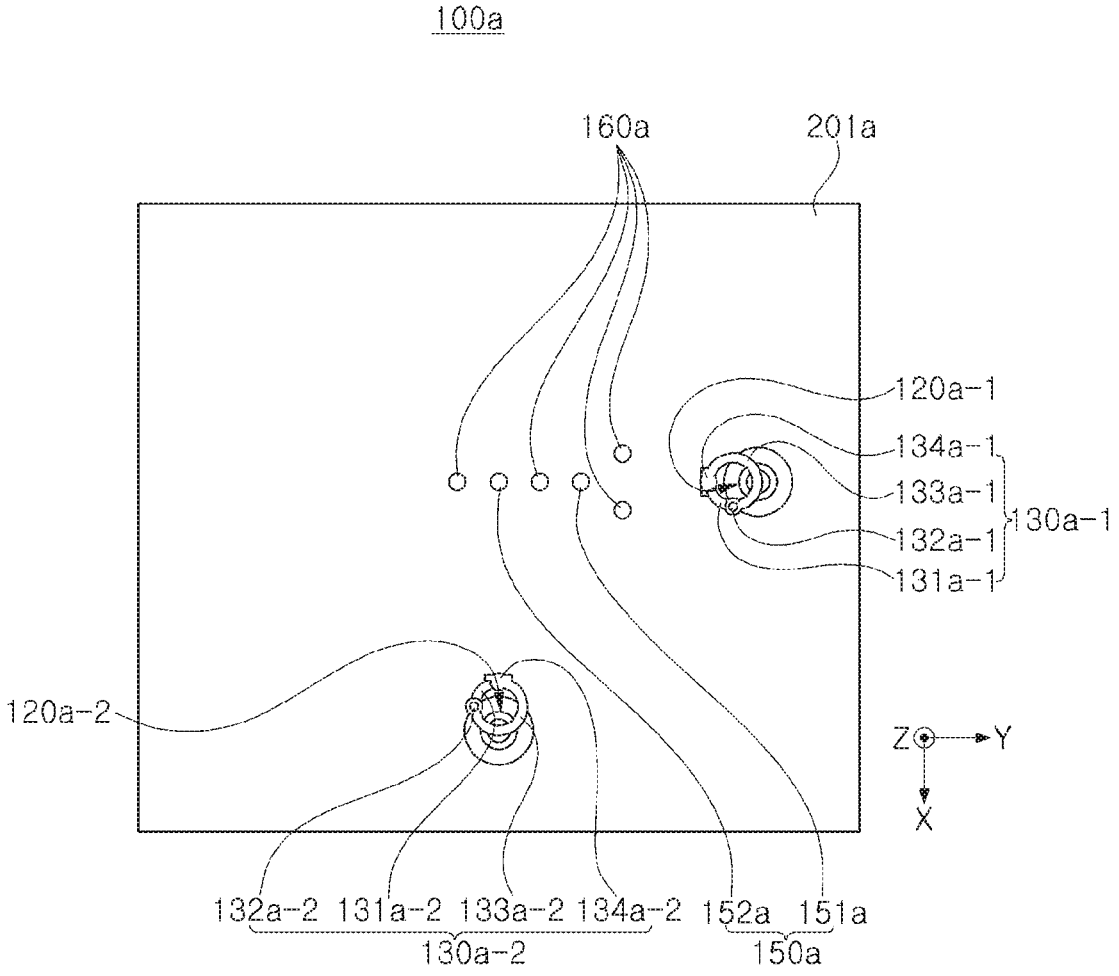
FIG. 3D is a plan view illustrating an antenna apparatus and a coiled feed pattern according to an embodiment of the present disclosure.

FIG. 3D is a plan view illustrating an antenna apparatus and a coiled feed pattern according to an embodiment of the present disclosure.

Referring to FIG. 3D, an antenna apparatus 100*a* according to an embodiment of the present disclosure may include a plurality of first feed vias 120*a*-1 and 120*a*-2 and a plurality of coiled feed patterns 130*a*-1 and 130*a*-2, and may further include a plurality of second feed vias 150*a* and a plurality of ground vias 160*a*.

The plurality of coiled feed patterns 130*a*-1 and 130*a*-2 may include at least one of a plurality of first coiled feed patterns 131*a*-1 and 131*a*-2, a plurality of inductive vias 132*a*-1 and 132*a*-2, and a plurality of second coiled feed patterns 133*a*-1 and 133*a*-2. The plurality of second coiled feed patterns 133*a*-1 and 133*a*-2 may include a plurality of extension portions 134*a*-1 and 134*a*-2.

When sizes of a plurality of extended patch antenna patterns are different from each other, a portion of one coiled feed pattern, among the plurality of coiled feed patterns 130*a*-1 and 130*a*-2, may be disposed so as not to overlap the plurality of extended patch antenna patterns in the vertical direction, and the other coiled feed pattern, among the plurality of coiled feed patterns 130*a*-1 and 130*a*-2, may be disposed to further overlap the plurality of extended patch antenna patterns in the vertical direction.

In addition, the plurality of coiled feed patterns 130*a*-1 and 130*a*-2 may be arranged such that a coiling axis of the coiled portion is further biased from the plurality of first feed vias 120*a*-1 and 120*a*-2 to the first patch antenna pattern.

Therefore, efficiency for electricity feeding the plurality of coiled feed patterns 130*a*-1 and 130*a*-2 on the first patch antenna patterns may be further improved.

Figure 4A:
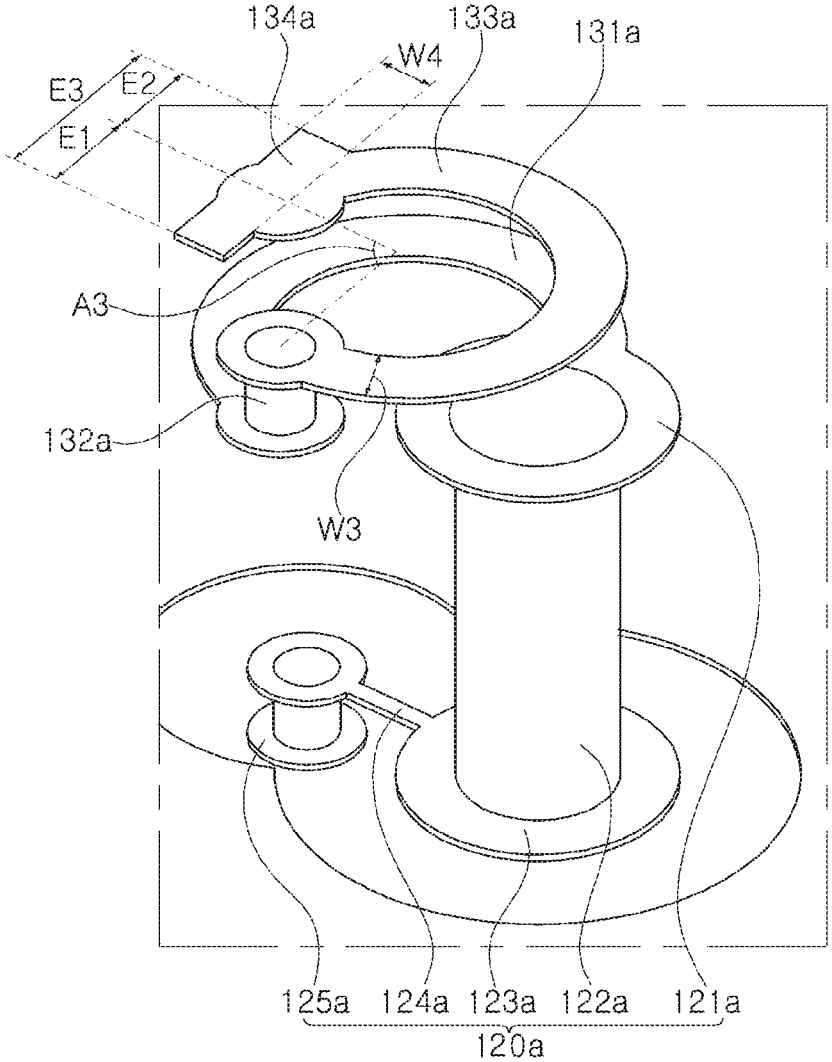
FIGS. 4A and 4B are perspective views illustrating coiled feed patterns of antenna apparatuses according to embodiments of the present disclosure.
Figure 4B:
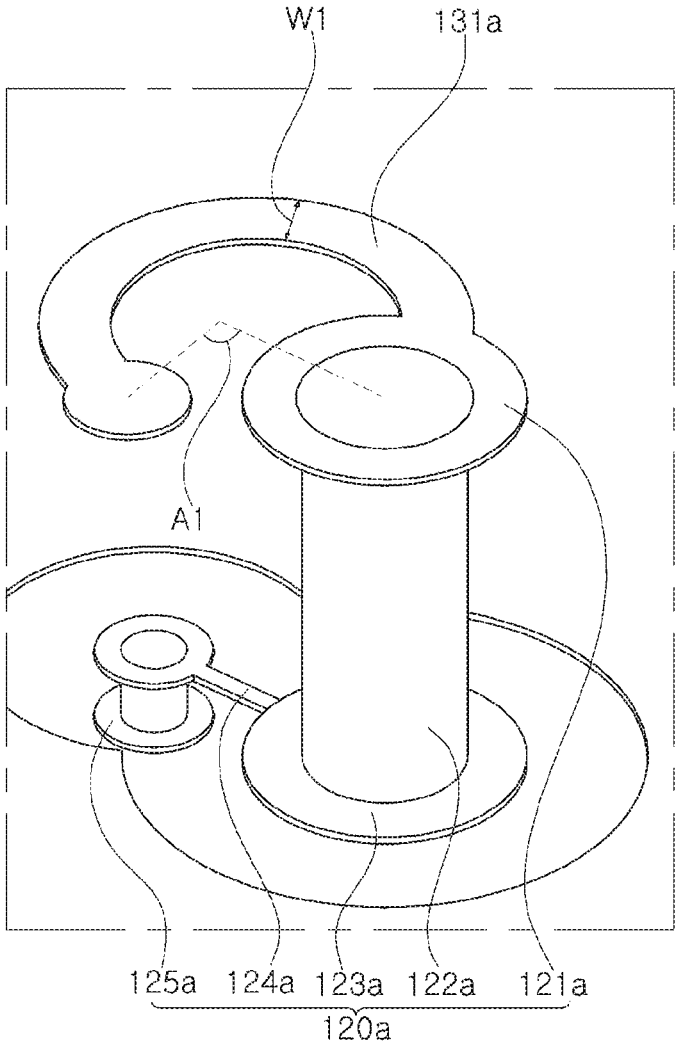

FIGS. 4A and 4B are perspective views illustrating coiled feed patterns of antenna apparatuses according to embodiments of the present disclosure.

Referring to FIG. 4A, one end of a first coiled feed pattern 131*a* may be electrically connected to a first feed via 120*a*, one end of an inductive via 132*a* may be electrically connected to the other end of the first coiled feed pattern 131*a*, one end of a second coiled feed pattern 133*a* may be electrically connected to the other end of the inductive via 132*a*, and at least a portion of the second coiled feed pattern 133*a* may overlap the first coiled feed pattern 131*a* in the vertical direction.

Therefore, since inductance of the coiled feed pattern relative to a size of the coiled feed pattern may increase, efficiency for electricity feeding the coiled feed pattern may be further improved.

In addition, a coiled portion of the coiled feed pattern may be a form in which n and a half turns are coiled, where n is a natural number. For example, coiling angles of the first and second coiled feed patterns 131*a* and 133*a* may exceed 180 degrees, and an angle (A3) formed by an imaginary line extending from a coiling axis of the coiled feed pattern toward the inductive via 132*a*, and an imaginary line extending from the coiling axis of the coiled feed pattern toward an extension portion 134*a* may be less than 180 degrees.

Therefore, since a position of the extension portion 134*a* may be closer to a first patch antenna pattern, efficiency for electricity feeding the coiled feed pattern may be further improved.

Inductance of the coiled feed pattern and efficiency for electricity feeding the coiled feed pattern may be determined, based on a width (W3) of the second coiled feed pattern 133*a*, a plurality of extension lengths (E1 and E2) of the extension portion 134*a*, and an entire extension length (E3) of the extension portion 134*a*. For example, inductance of the coiled feed pattern and efficiency for electricity feeding the coiled feed pattern may be determined, based on a width (W1) of the first coiled feed pattern 131*a*, a width (W3) of the second coiled feed pattern 133*a*, a width (W4) of the extension portion 134*a*, a plurality of extension lengths (E1 and E2) of the extension portion 134*a*, and an entire extension length (E3) of the extension portion 134*a*.

The first feed via 120*a* may include at least one of a 1-1-th electricity feed portion 121*a*, a 1-2-th electricity feed portion 122*a*, a 1-3-th electricity feed portion 123*a*, a 1-4-th electricity feed portion 124*a*, and a 1-5-th electricity feed portion 125*a*.

Referring to FIG. 4B, a coiled feed pattern may have a structure in which an inductive via, a second coiled feed pattern, and an extension portion are omitted, and a first coiled feed pattern 131*a* is included, and may be electrically connected to a first feed via 120*a*.

For example, an angle (A1) formed by a plurality of imaginary lines extending toward one end and the other end of the first coiled feed pattern 131*a* from a coiling axis of the first coiled feed pattern 131*a* may be less than 180 degrees.

Figure 5A:
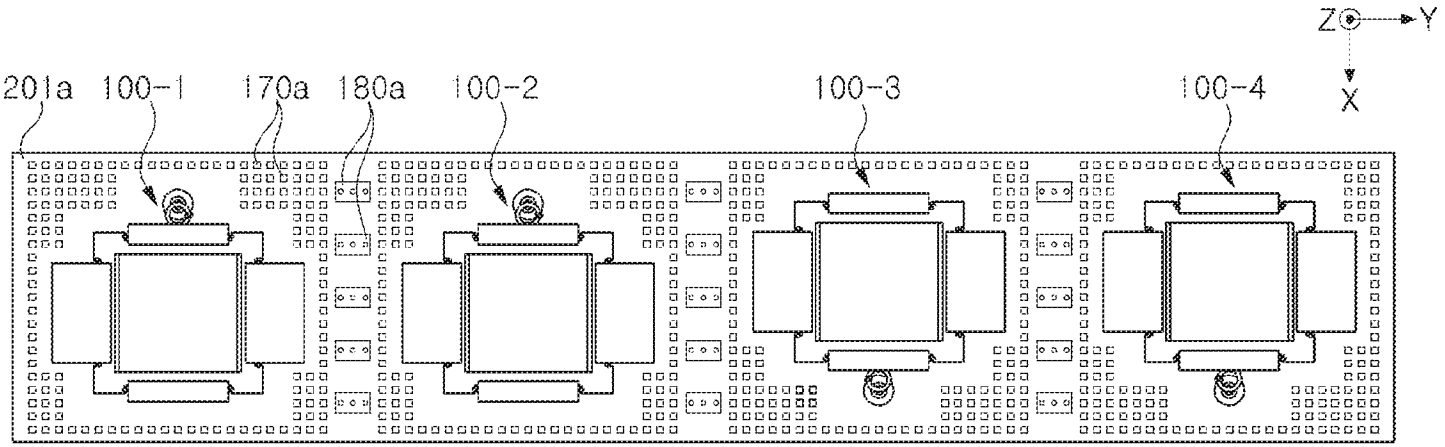
FIG. 5A is a plan view illustrating an arrangement of a plurality of antenna apparatuses according to an embodiment of the present disclosure.
Figure 5B:
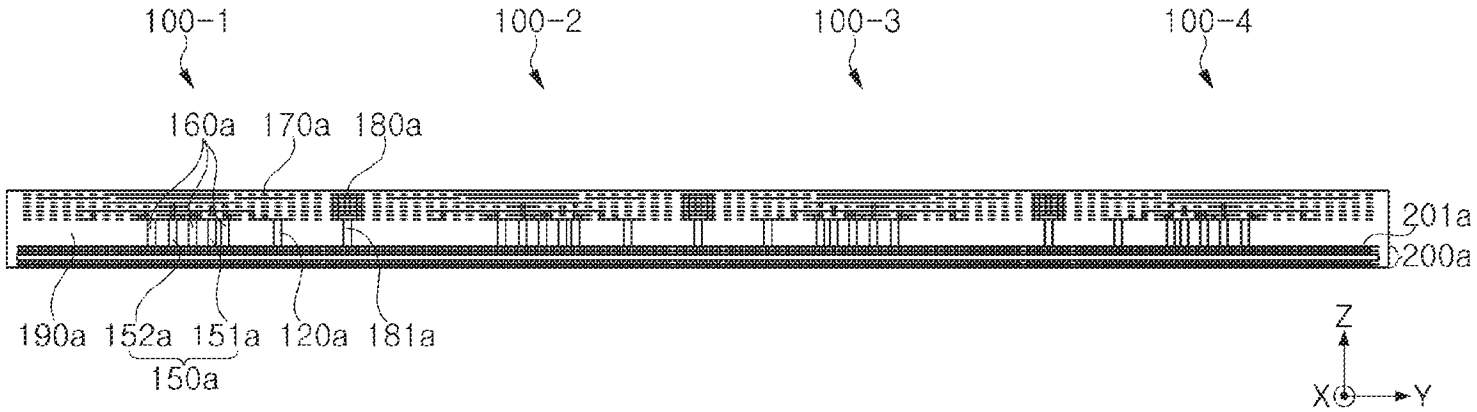
FIG. 5B is a cross-sectional view illustrating an arrangement of a plurality of antenna apparatuses according to an embodiment of the present disclosure.

FIG. 5A is a plan view illustrating an arrangement of a plurality of antenna apparatuses according to an embodiment of the present disclosure, and FIG. 5B is a cross-sectional view illustrating an arrangement of a plurality of antenna apparatuses according to an embodiment of the present disclosure.

Referring to FIGS. 5A and 5B, a plurality of antenna apparatuses 100-1, 100-2, 100-3, and 100-4 according to an embodiment of the present disclosure may be arranged in the y direction, and may be arranged on a ground plane 201*a*. The ground plane 201*a* may be included in a connection member 200*a* disposed below a dielectric layer 190*a*. The first feed via 120*a* may be disposed to penetrate the dielectric layer 190*a* by at least a portion of a thickness of the dielectric layer 190*a*.

A plurality of pixel patterns 170*a* may surround each of the plurality of antenna apparatuses 100-1, 100-2, 100-3, and 100-4, and a shielding structure 180*a* may be disposed to interpose between the plurality of antenna apparatuses

100-1, 100-2, 100-3, and 100-4. The shielding structure 180*a* may be electrically connected to the ground plane 201*a* through a shielding via 181*a*.

Figure 6A:
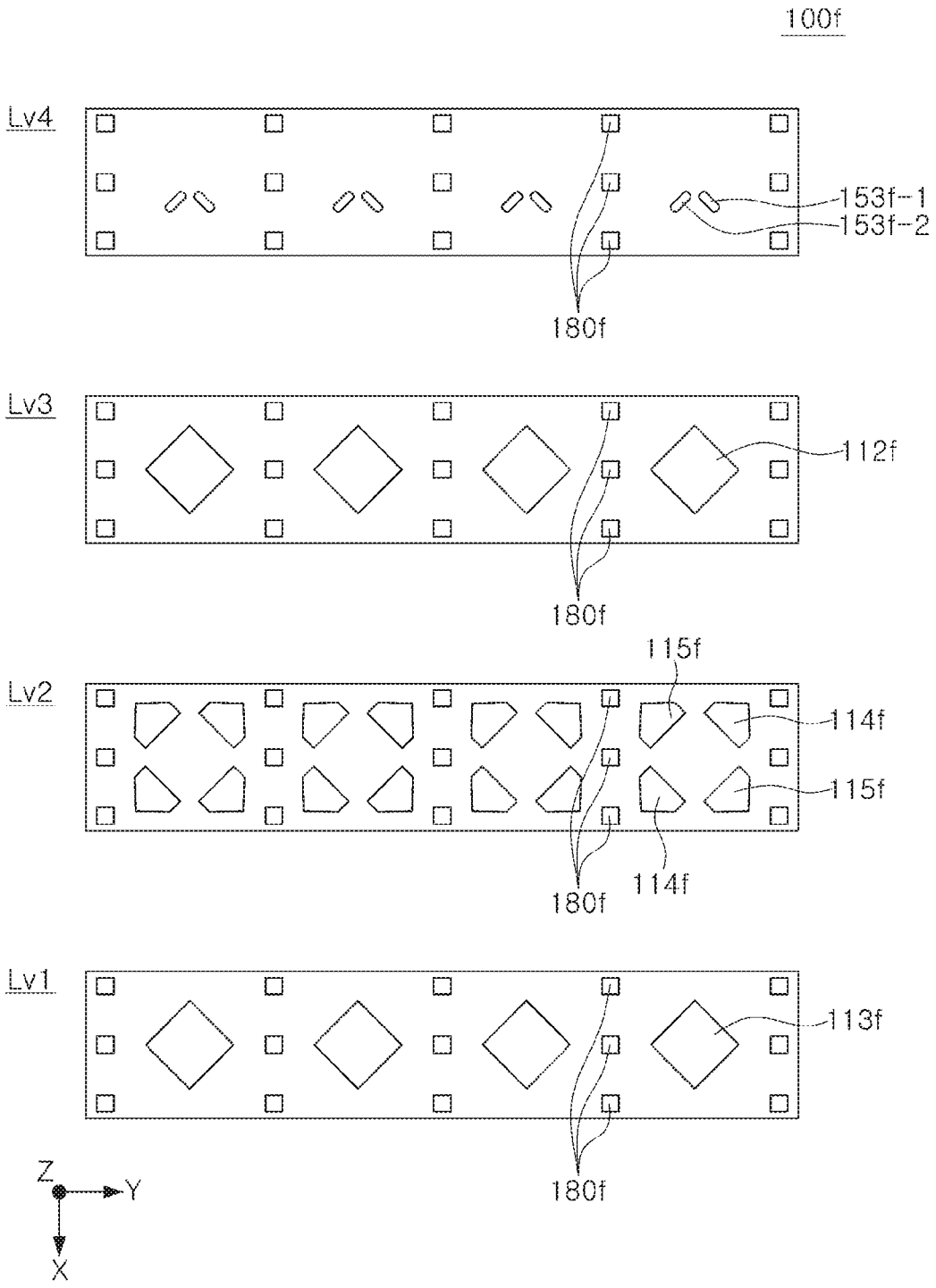
FIGS. 6A and 6B are plan views illustrating a layered structure of a slant antenna apparatus according to an embodiment of the present disclosure.
Figure 6B:
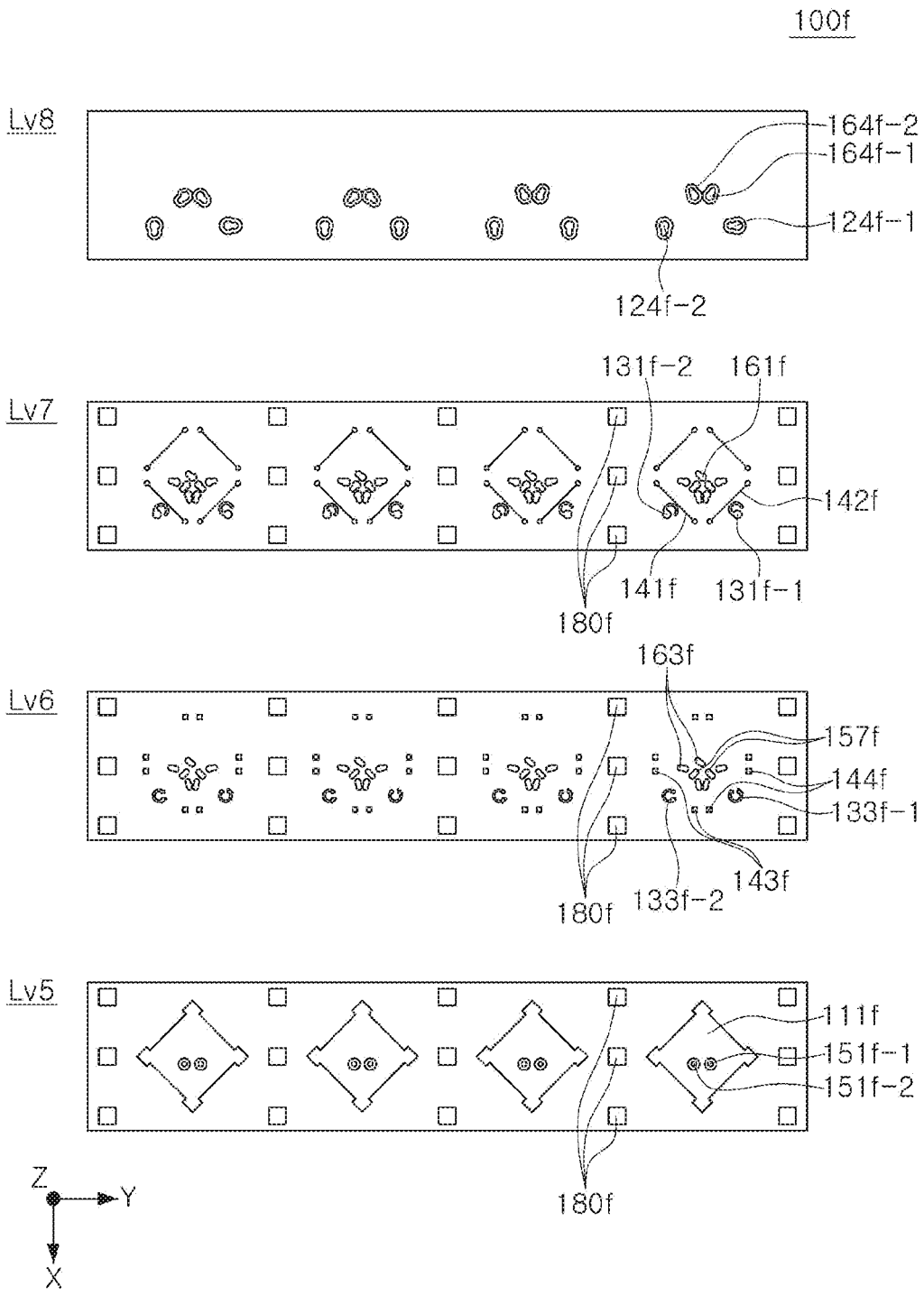

FIGS. 6A and 6B are plan views illustrating a layered structure of a slant antenna apparatus according to an embodiment of the present disclosure.

Referring to FIGS. 6A and 6B, a slant antenna apparatus 100*f* according to an embodiment of the present disclosure may include a first layer Lv1, a second layer Lv2, a third layer Lv3, a fourth layer Lv4, a fifth layer Lv5, a sixth layer Lv6, a seventh layer Lv7, and an eighth layer Lv8, stacked in sequence.

A plurality of first patch antenna patterns 111*f* disposed on the fifth layer Lv5, a plurality of second patch antenna patterns 112*f* and disposed on the third layer Lv3, and a plurality of third patch antenna patterns 113*f* disposed on the first layer Lv1 may have a form in which the first, second, and third patch antenna patterns, illustrated in FIG. 1A to FIG. 5B, are rotated at an acute angle (e.g., 45 degrees), respectively.

For example, in the plurality of the first, second, and third patch antenna patterns 111*f*, 112*f*, and 113*f*, respective sides thereof may be oriented in an oblique direction with respect to respective sides (e.g., an x direction side, a y direction side) of the upper surface of the ground plane 201*a* illustrated in FIG. 1A, and may be oriented in an oblique direction with respect to respective sides of the upper surface of the dielectric layer 190*b* illustrated in FIG. 2A.

The plurality of first, second, and third patch antenna patterns 111*f*, 112*f*, and 113*f* may be arranged in a direction, parallel or perpendicular to respective sides of the upper surface of the ground plane (or the dielectric layer). Therefore, the plurality of first, second, and third patch antenna patterns 111*f*, 112*f*, and 113*f* may be arranged in a more space-efficient manner. For example, the plurality of the first patch antenna patterns 111*f* may be arranged in the y direction, the plurality of second patch antenna patterns 112*f* may be arranged in they direction, and the plurality of the third patch antenna patterns 113*f* may be arranged in the y direction.

For example, in the plurality of first, second, and third patch antenna pattern 111*f*, 112*f*, and 113*f*, respective sides thereof may be oriented in an oblique direction with respect to arrangement (e.g., they direction) of the plurality of first, second, and third patch antenna patterns 111*f*, 112*f*, and 113*f*.

Therefore, since electric and magnetic fields based on a surface current flowing through the plurality of first, second, and third patch antenna patterns 111*f*, 112*f*, and 113*f* may be formed by further avoiding adjacent patch antenna patterns, electromagnetic interference of the plurality of first, second, and third patch antenna patterns 111*f*, 112*f*, and 113*f* with each other may be reduced, and the plurality of first, second, and third patch antenna patterns 111*f*, 112*f*, and 113*f* may have improved gain, compared to a size thereof.

A plurality of aperture patterns 141*f* and 142*f* arranged in the seventh layer Lv7 and a plurality of aperture vias 143*f* and 144*f* arranged to connect the sixth layer Lv6 and the seventh layer Lv7 may be disposed in a position corresponding to a shape rotated by an acute angle (e.g., 45 degrees) of the first, second, and third patch antenna patterns 111*f*, 112*f*, and 113*f*.

A plurality of first coiled feed patterns 131*f*-1 and 131*f*-2 arranged in the seventh layer Lv 7 and the plurality of second coiled feed patterns 133*f*-1 and 133*f*-2 arranged in the sixth layer Lv6 may be disposed in a position corresponding to a shape rotated by an acute angle (e.g., 45 degrees) of the plurality of first, second, and third patch antenna patterns 111*f*, 112*f*, and 113*f*.

The plurality of first coiled feed patterns 131*f*-1 and 131*f*-2 and the plurality of second coiled feed patterns 133*f*-1 and 133*f*-2 may be arranged to be spaced apart by a pre-designated separation distance from the plurality of first, second, and third patch antenna patterns 111*f*, 112*f*, and 113*f* in an acute angle (e.g., 45 degrees) direction.

A design range of the separation distance may be further widened due to the shapes rotated by the acute angle (e.g., 45 degrees) of the plurality of first, second, and third patch antenna patterns 111*f*, 112*f*, and 113*f*.

Therefore, the plurality of first coiled feed patterns 131*f*-1 and 131*f*-2 and the plurality of second coiled feed patterns 133*f*-1 and 133*f*-2 may utilize a wider separation distance design range, to further increase electromagnetic coupling efficiencies of the plurality of first, second, and third patch antenna patterns 111*f*, 112*f*, and 113*f*, and further enhance gains and/or bandwidths of the plurality of first, second, and third patch antenna patterns 111*f*, 112*f*, and 113*f*.

The overall y direction symmetry of the plurality of first coiled feed patterns 131*f*-1 and 131*f*-2, and the overall y direction symmetry of the plurality of second coiled feed patterns 133*f*-1 and 133*f*-2 may be further improved, due to the shape rotated by an acute angle (e.g., 45 degrees) of the plurality of first, second, and third patch antenna patterns 111*f*, 112*f*, and 113*f*.

A difference between antenna performance due to the plurality of 1-1-th coiled feed patterns 131*f*-1, and antenna performance due to the plurality of 1-2-th coiled feed patterns 131*f*-2, among the plurality of first coiled feed patterns 131*f*-1 and 131*f*-2, may be relatively small. A difference between antenna performance due to the plurality of 2-1-th coiled feed patterns 133*f*-1, and antenna performance due to the plurality of 2-2-th coiled feed patterns 133*f*-2, among the plurality of second coiled feed patterns 133*f*-1 and 133*f*-2, may be relatively small.

A slant antenna apparatus 100*f* according to an embodiment of the present disclosure may remotely transmit and/or receive first and second RF signals that are polarized with each other, and the plurality of 1-1-th coiled feed patterns 131*f*-1 and the plurality of 2-1-th coiled feed patterns 133*f*-1 may be configured as a feed path of the first RF signal, and the plurality of 1-2-th coiled feed patterns 131*f*-2 and the plurality of 2-2-th coiled feed pattern 133*f*-2 may be configured as a feed path of the second RF signal.

The overall antenna performance of the slant antenna apparatus 100*f* according to an embodiment of the present disclosure, with respect to the first and second RF signals, may be higher, as a degree of electromagnetic isolation between the first and second RF signals is higher.

The degree of electromagnetic isolation between the first and second RF signals may be higher, as the overall y direction symmetry of the plurality of first coiled feed patterns 131*f*-1 and 131*f*-2 is higher, and may be higher, as the overall y direction symmetry of the plurality of second coiled feed patterns 133*f*-1 and 133*f*-2 is higher.

The overall y direction symmetry of the plurality of first coiled feed patterns 131*f*-1 and 131*f*-2, and the overall y direction symmetry of the plurality of second coiled feed patterns 133*f*-1 and 133*f*-2 may be further improved, due to the shape rotated by an acute angle (e.g., 45 degrees) of the plurality of first, second, and third patch antenna patterns 111*f*, 112*f*, and 113*f*, and the overall antenna performance (e.g., gain and bandwidth) of the antenna apparatus 100*f* with respect to the first and second RF signals may be improved.

A plurality of extended patch antenna patterns 114*f* and 115*f* arranged in the second layer Lv2 may be disposed in a position corresponding to a shape rotated by an acute angle (e.g., 45 degrees) of the plurality of first, second, and third patch antenna patterns 111*f*, 112*f*, and 113*f*. The plurality of extended patch antenna patterns 114*f* and 115*f* may be arranged to be spaced apart from sides of the plurality of first, second, and third patch antenna patterns 111*f*, 112*f*, and 113*f*.

For example, in the plurality of extended patch antenna patterns 114*f* and 115*f*, the closest side (e.g., an inner side) to the plurality of first, second, and third patch antenna patterns 111*f*, 112*f*, and 113*f* may be oriented in an oblique direction with respect to at least two sides (e.g., outer sides), among remaining sides thereof.

For example, at least a portion of each of the plurality of extended patch antenna patterns 114*f* and 115*f* may have a wider shape closer to the plurality of first, second, and third patch antenna patterns 111*f*, 112*f*, and 113*f*.

Therefore, since the plurality of extended patch antenna patterns 114*f* and 115*f* may further concentrate directions of electric and magnetic fields due to surface currents of the plurality of first, second, and third patch antenna patterns 111*f*, 112*f*, and 113*f* on an acute angle (e.g., 45 degree) direction, a gain of the plurality of first, second, and third patch antenna patterns 111*f*, 112*f*, and 113*f* may be further improved, compared to a size thereof.

In addition, among the plurality of extended patch antenna patterns 114*f* and 115*f*, an extended patch antenna pattern 115*f* overlapping the plurality of 1-1-th coiled feed patterns 131*f*-1 and the plurality of 2-1-th coiled feed patterns 133*f*-1 in the vertical direction, and an extended patch antenna pattern 114*f* overlapping the plurality of 1-2-th coiled feed patterns 131*f*-2 and the plurality of 2-2-th coiled feed patterns 133*f*-2 in the vertical direction, may be configured to have shapes symmetrical with each other.

Therefore, the degree of electromagnetic isolation between the first and second RF signals may be further improved, and the overall antenna performance (e.g., gain, bandwidth) of the slant antenna apparatus 100*f* according to an embodiment of the present disclosure, with respect to the first and second RF signals, may be further improved.

2-1-th electricity feed portions 151*f*-1 and 151*f*-2 of the second feed via passing through the fifth layer Lv5, and 2-2-th electricity feed portions 153*f*-1 and 153*f*-2 of the second feed via disposed in the fourth layer Lv4 may be disposed in a position corresponding to a shape rotated by an acute angle (e.g., 45 degrees) of the plurality of first, second, and third patch antenna patterns 111*f*, 112*f*, and 113*f*, and a feed path of an RF signal of a first frequency (e.g., 28 GHz) and a feed path of an RF signal of a second frequency (e.g., 39 GHz) in the plurality of first and second coiled feed patterns 131*f*-1, 131*f*-2, 133*f*-1, and 133*f*-2 may be provided.

A plurality of first surrounding patterns 161*f* of a plurality of ground vias disposed in the seventh layer Lv7 and a plurality of second surrounding patterns 163*f* of a plurality of ground vias disposed in the sixth layer Lv6 may be included in the plurality of ground vias 160*a* and 160*b* illustrated in FIGS. 2*a* and 3*d*, and may be arranged to surround the second feed via.

2-4-th electricity feed portions 157*f* of the second feed via disposed in the sixth layer Lv6 and/or the seventh layer Lv7 may extend in a direction (e.g., the horizontal direction), parallel to the plurality of first, second, and third patch antenna patterns 111*f*, 112*f*, and 113*f*.

Therefore, since the 2-4-th electricity feed portions 157*f* of the second feed via may provide additional inductance with respect to at least one of the plurality of first, second, and third patch antenna patterns 111*f*, 112*f*, and 113*f*, a bandwidth of at least one of the plurality of first, second, and third patch antenna patterns 111*f*, 112*f*, and 113*f* may be more efficiently widened.

For example, a slant antenna apparatus 100*f* according to an embodiment of the present disclosure may use at least one of various design elements (e.g., at least one specific structure of coiled feed patterns, aperture portions, feed vias, and patch antenna patterns) that is advantageous for bandwidth expansion, to have a first frequency band (e.g., 24 GHz to 30 GHz) and a second frequency band (e.g., 37 GHz to 43 GHz), having a wide bandwidth of about 6 GHz, respectively.

In this case, the lowest frequency (e.g., a lower frequency of two frequencies in which an input/output S-parameter of a single port is −10 dB) and the highest frequency (e.g., a higher frequency of two frequencies in which an input/output S-parameter of a single port is −10 dB) of each of the first and second frequency bands may vary, depending on a design, and may be designed to have a range of 20 GHz to 60 GHz.

The plurality of first surrounding patterns 161*f* and the plurality of second surrounding patterns 163*f* may extend in a direction (e.g., a horizontal direction), parallel with respect to the plurality of first, second, and third patch antenna patterns 111*f*, 112*f*, and 113*f*, and may be disposed to surround the 2-4-th electricity feed portions 157*f* of the second feed via.

Therefore, the plurality of first surrounding patterns 161*f* and the plurality of second surrounding patterns 163*f* may have a structure more adaptive to an increase in horizontal area according to the 2-4-th electricity feed portions 157*f* of the second feed via, and may further improve a degree of electromagnetic isolation between the RF signal of the first frequency (e.g., 28 GHz) and the RF signal of the second frequency (e.g., 39 GHz).

A plurality of 1-4-th electricity feed portions 124*f*-1 and 124*f*-2 electrically connected to the plurality of first and second coiled feed patterns 131*f*-1, 131*f*-2, 133*f*-1, and 133*f*-2 of the first feed via may be arranged in the eighth layer Lv8, and 2-5-th electricity feed portions 164*f*-1 and 164*f*-2 electrically connected to the 2-4-th electricity feed portions 157*f* of the second feed via may be arranged in the eighth layer Lv8. The eighth layer Lv8 may also provide an arrangement space of the ground plane 201*a* illustrated in FIG. 1A.

A shielding structure 180*f* may be disposed in a space between the plurality of first patch antenna patterns 111*f*, a space between the plurality of second patch antenna patterns 112*f*, and a space between the plurality of third patch antenna patterns 113*f*, may be disposed in the first layer Lv1, the second layer Lv2, the third layer Lv3, the fourth layer Lv4, the fifth layer Lv5, the sixth layer Lv6, and the seventh layer Lv7, may be electrically connected to the ground plane 201*a* illustrated in FIG. 1A, and may be connected to each other through a via.

Figure 7A:
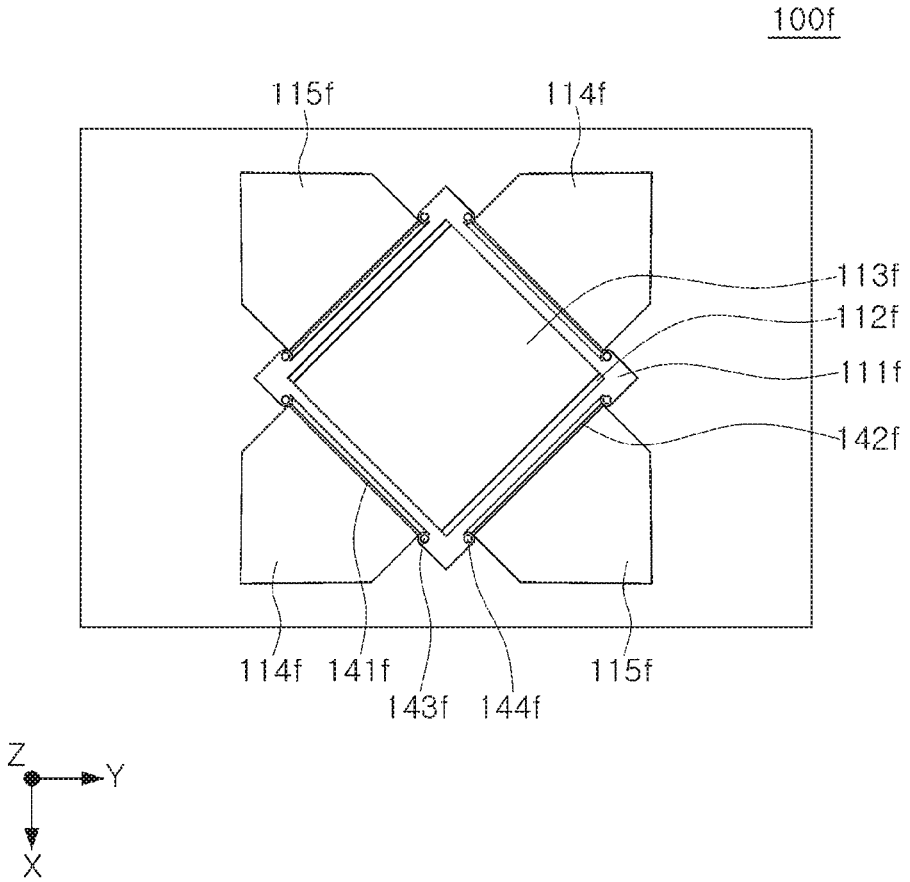
FIGS. 7A to 7C are plan views illustrating a form in which a plurality of layers of a slant antenna apparatus according to an embodiment of the present disclosure are combined.
Figure 7B:
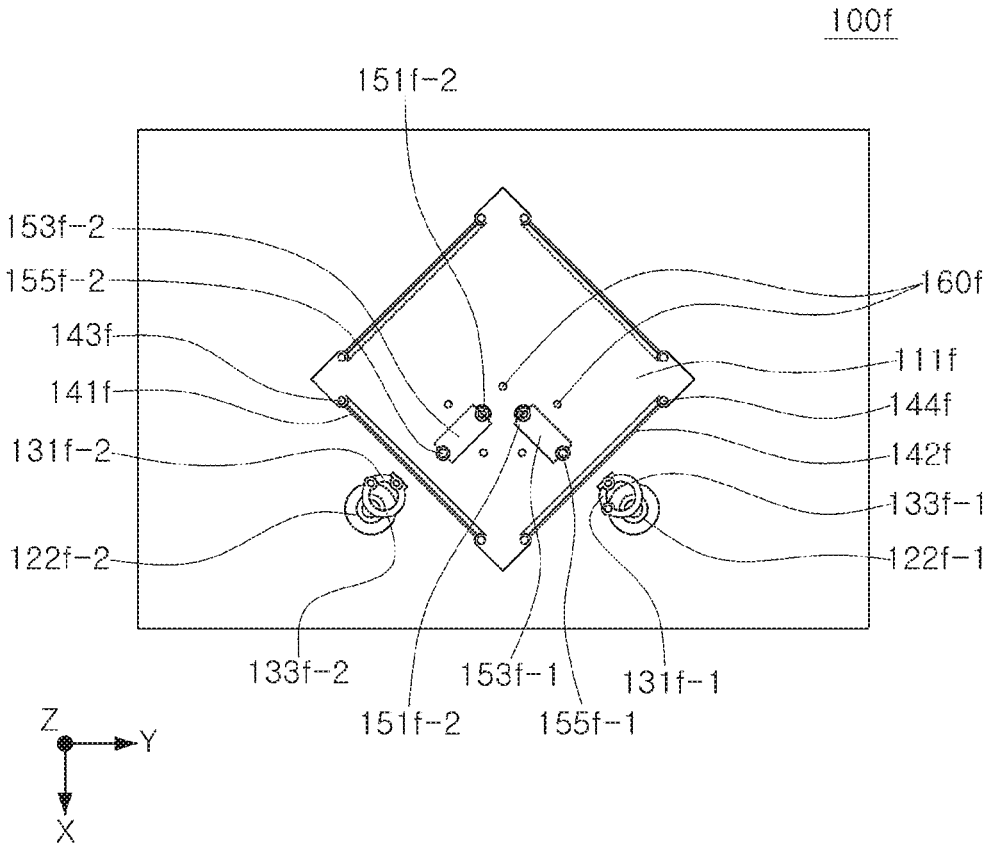
Figure 7C:
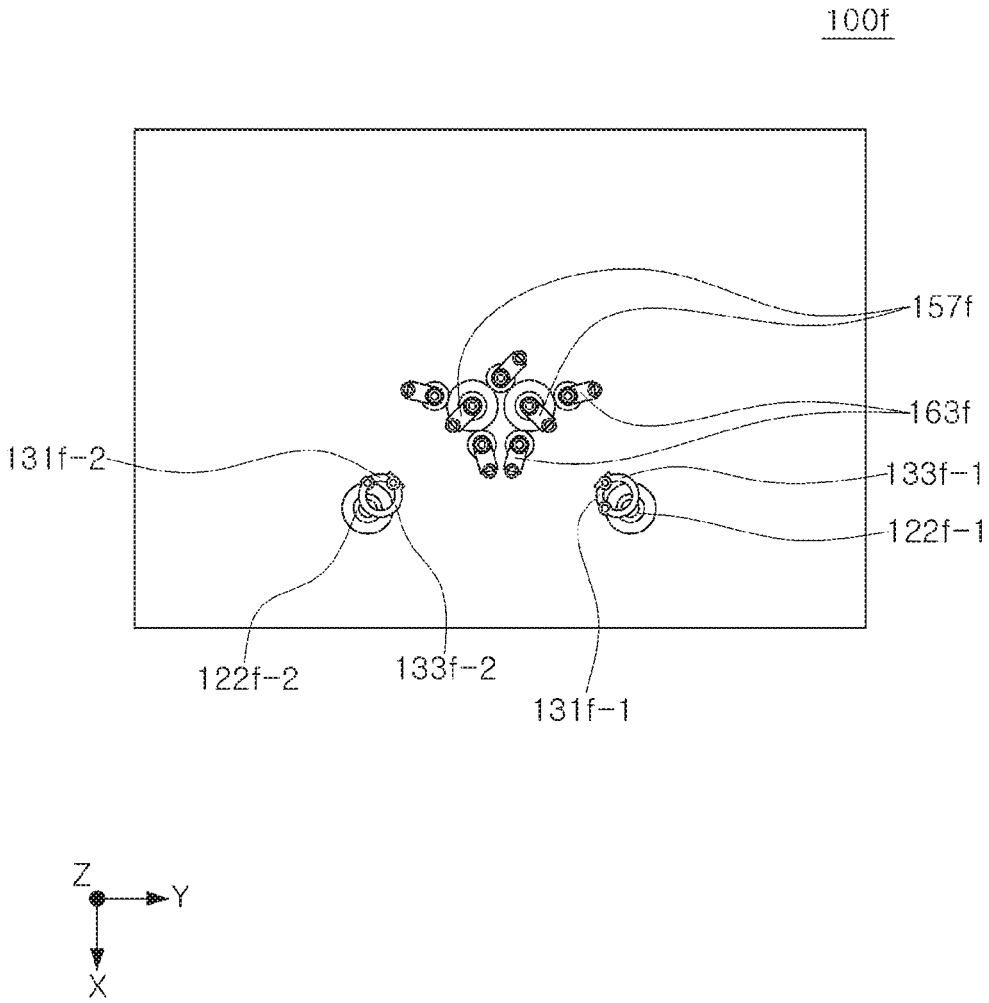

FIGS. 7A to 7C are plan views illustrating a form in which a plurality of layers of a slant antenna apparatus according to an embodiment of the present disclosure are combined.

Referring to FIG. 7A, a slant antenna apparatus 100*f* according to an embodiment of the present disclosure may include second and third patch antenna patterns 112*f* and 113*f*, a plurality of extended patch antenna patterns 114*f* and 115*f*, a plurality of aperture patterns 141*f* and 142*f*, and a plurality of aperture vias 143*f* and 144*f*, and may have a shape rotated by an acute angle (e.g., 45 degrees), compared to the antenna apparatus illustrated in FIGS. 1A to 5B.

Referring to FIG. 7B, a slant antenna apparatus 100*f* according to an embodiment of the present disclosure may include a first patch antenna pattern 111*f*, 1-2-th electricity feed portions 122*f*-1 and 122*f*-2, first coiled feed patterns 131*f*-1 and 131*f*-2, second coiled feed patterns 133*f*-1 and 133*f*-2, a plurality of aperture patterns 141*f* and 142*f*, a plurality of aperture vias 143*f* and 144*f*, 2-1-th electricity feed portions 151*f*-1 and 151*f*-2, 2-2-th electricity feed portions 153*f*-1 and 153*f*-2, 2-3-th electricity feed portions 155*f*-1 and 155*f*-2, and a plurality of ground vias 160*f*, and may have a form rotated by an acute angle (e.g., 45 degrees), compared to the antenna apparatus illustrated in FIGS. 1A to 5B.

A plurality of aperture portions may include the plurality of aperture patterns 141*f* and 142*f* and the plurality of aperture vias 143*f* and 144*f*, a first feed via may include the 1-2-th electricity feed portions 122*f*-1 and 122*f*-2, a second feed via may include the 2-1-th electricity feed portions 151*f*-1 and 151*f*-2, the 2-2-th electricity feed portions 153*f*-1 and 153*f*-2, and the 2-3-th electricity feed portions 155*f*-1 and 155*f*-2, and a coiled feed pattern may include the first coiled feed patterns 131*f*-1 and 131*f*-2 and the second coiled feed patterns 133*f*-1 and 133*f*-2.

Also, a plurality of directions extending from one end of a coiled form of the second coiled feed patterns 133*f*-1 and 133*f*-2 may be acute angles (e.g., 45 degrees). Therefore, the coiled feed patterns may further improve electromagnetic coupling efficiency with respect to the first patch antenna pattern 111*f*.

Referring to FIG. 7C, a slant antenna apparatus 100*f* according to an embodiment of the present disclosure may include 1-2-th electricity feed portions 122*f*-1 and 122*f*-2, first coiled feed pattern 131*f*-1 and 131*f*-2, second coiled feed patterns 133*f*-1 and 133*f*-2, a 2-4-th electricity feed portion 157*f*, and a plurality of second surrounding patterns 163*f*, and may have a form rotated by an acute angle (e.g., 45 degrees), compared to the antenna apparatus illustrated in FIGS. 1A to 5B.

Figure 8A:
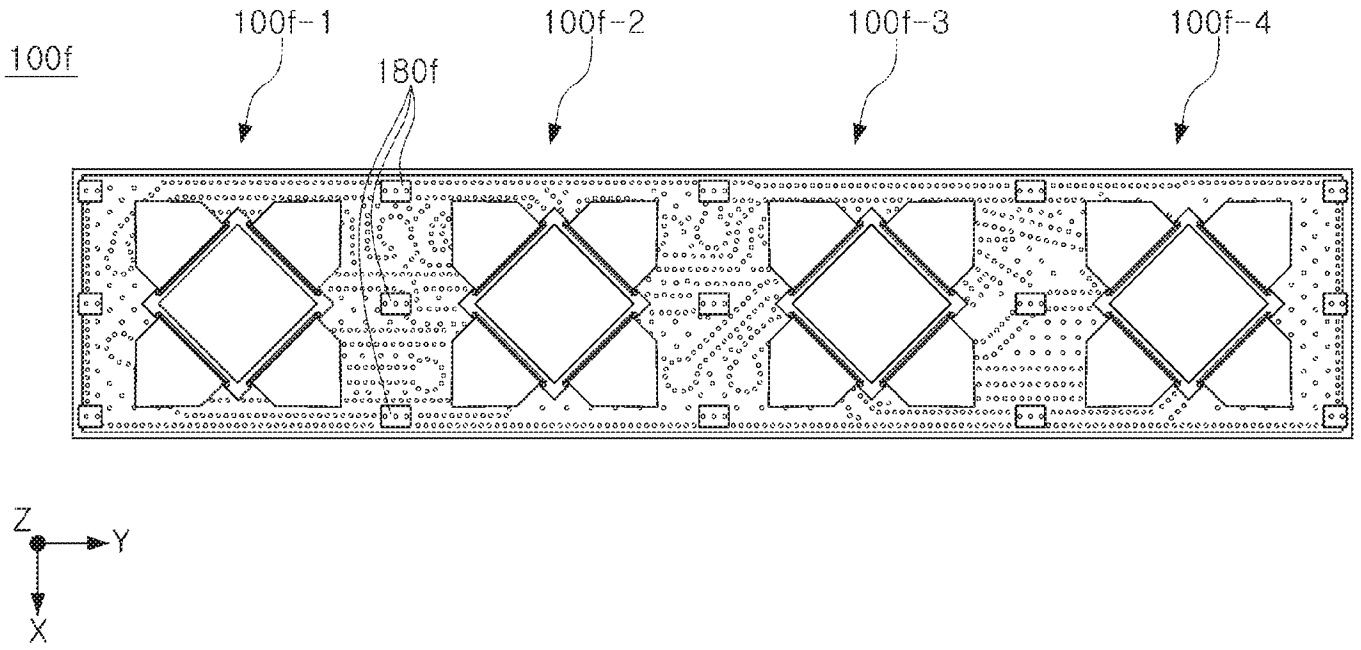
FIG. 8A is a plan view illustrating arrangement of a slant antenna apparatus according to an embodiment of the present disclosure.
Figure 8B:
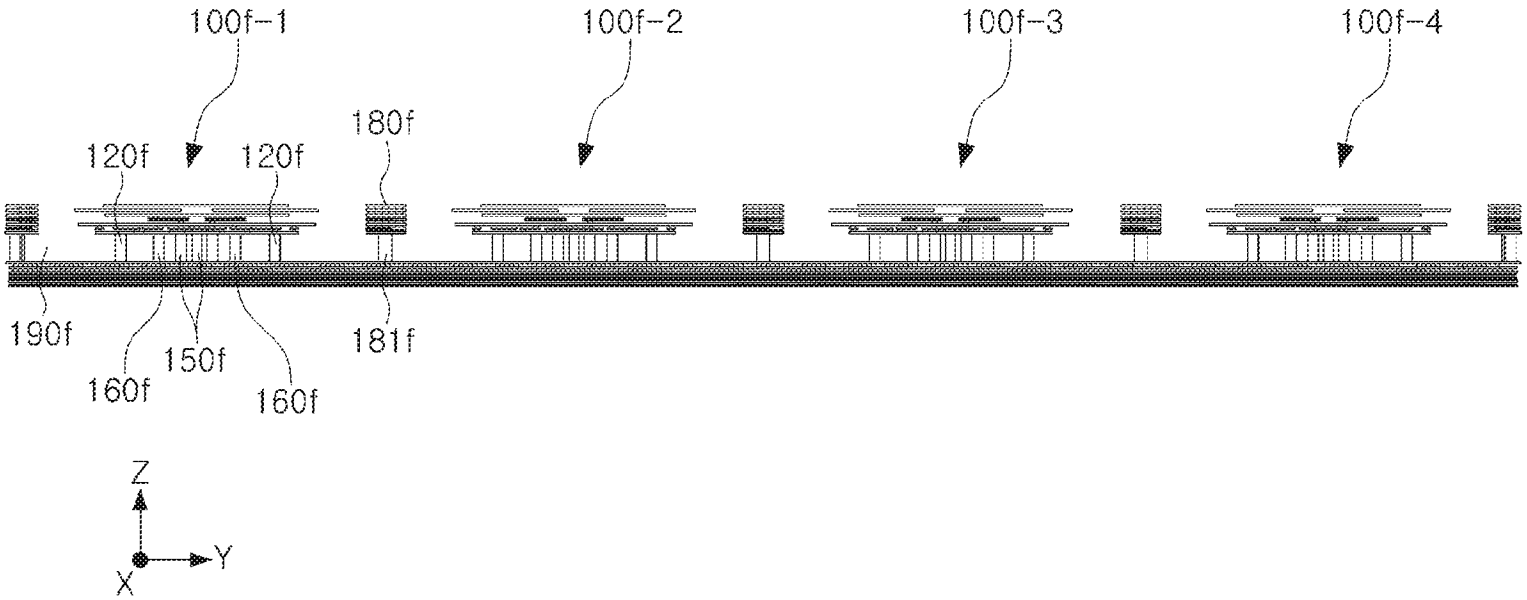
FIG. 8B is a side view illustrating an arrangement of a slant antenna apparatus according to an embodiment of the present disclosure.

FIG. 8A is a plan view illustrating arrangement of a slant antenna apparatus according to an embodiment of the present disclosure, and FIG. 8B is a side view illustrating arrangement of a slant antenna apparatus according to an embodiment of the present disclosure.

Referring to FIGS. 8A and 8B, a slant antenna apparatus 100*f* according to an embodiment of the present disclosure may include a plurality of antenna units 100*f*-1, 100*f*-2, 100*f*-3, and 100*f*-4, arranged in the y direction.

The plurality of antenna units 100*f*-1, 100*f*-2, 100*f*-3, and 100*f*-4 may have a form rotated by an acute angle (e.g., 45 degrees), compared to the antenna apparatus illustrated in FIGS. 1A to 5B, respectively, and may block each other by a shielding structure 180*f*.

Figure 9A:
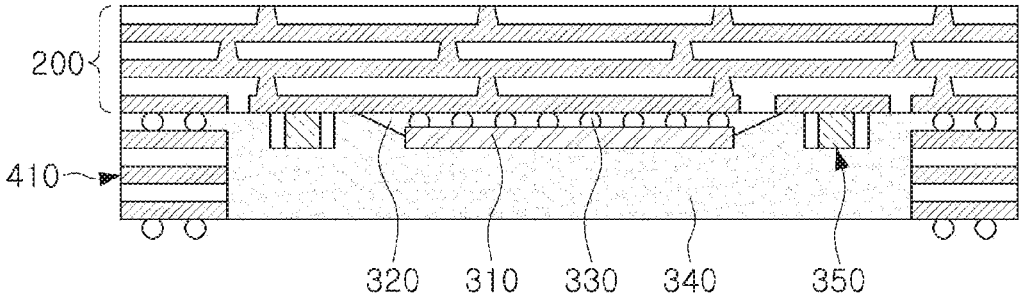
FIGS. 9A and 9B are cross-sectional views illustrating connection members in which a ground plane is stacked, and lower structures thereof, included in antenna apparatuses according to embodiments of the present disclosure.
Figure 9B:
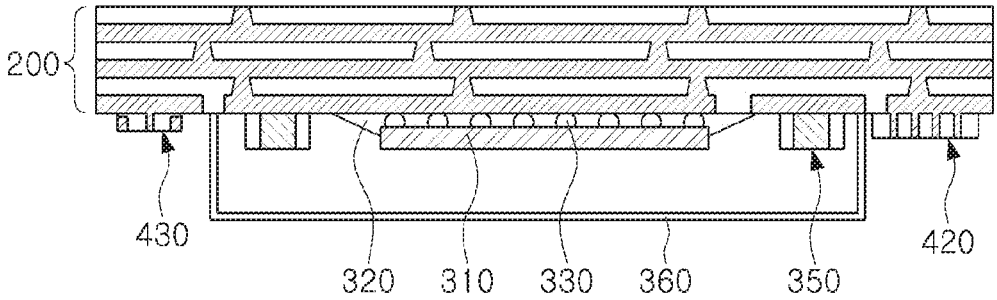

FIGS. 9A and 9B are cross-sectional views illustrating connection members in which a ground plane is stacked, and lower structures thereof, included in antenna apparatuses according to embodiments of the present disclosure.

Referring to FIG. 9A, an antenna apparatus according to an embodiment of the present disclosure may include at least a portion of a connection member 200, an IC 310, an adhesive member 320, an electrical connection structure 330, an encapsulant 340, a passive component 350, and a sub-substrate 410.

The connection member 200 may have a structure in which the plurality of ground planes described above are stacked.

The IC 310 may be the same as the above-described IC, and may be disposed below the connection member 200. The IC 310 may be electrically connected to a wiring of the connection member 200 to transmit or receive an RF signal, and may be electrically connected to a ground plane of the connection member 200 to receive a ground. For example, the IC 310 may perform at least a portion of frequency conversion, amplification, filtering, phase control, and power generation to generate a converted signal.

The adhesive member 320 may bond the IC 310 and the connection member 200 to each other.

The electrical connection structure 330 may electrically connect the IC 310 and the connection member 200. For example, the electrical connection structure 330 may have a structure such as a solder ball, a pin, a land, and a pad. The electrical connection structure 330 may have a lower melting point than the wiring and the ground plane of the connection member 200, to electrically connect the IC 310 and the connection member 200 through a predetermined process using the lower melting point.

The encapsulant 340 may encapsulate at least a portion of the IC 310, and may improve heat dissipation performance and impact protection performance of the IC 310. For example, the encapsulant 340 may be implemented with a photo imageable encapsulant (PIE), an Ajinomoto build-up film (ABF), an epoxy molding compound (EMC), or the like.

The passive component 350 may be disposed on a lower surface of the connection member 200, and may be electrically connected to the wiring and/or the ground plane of the connection member 200 through the electrical connection structure 330.

The sub-substrate 410 may be disposed below the connection member 200, and may be electrically connected to the connection member 200, to receive an intermediate frequency (IF) signal or a base band signal from an external source and transmit the received IF signal or the received base band signal to the IC 310, or receive an IF signal or a base band signal from the IC 310 to transmit the received IF signal or the received base band signal to the external source. In this case, a frequency (e.g., 24 GHz, 28 GHz, 36 GHz, 39 GHz, or 60 GHz) of an RF signal may be greater than a frequency (e.g., 2 GHz, 5 GHz, 10 GHz, etc.) of an IF signal.

For example, the sub-substrate 410 may transmit or receive an IF signal or a base band signal to or from the IC 310 through a wiring that may be included in an IC ground plane of the connection member 200. Since a first ground plane of the connection member 200 is disposed between the IC ground plane and the wiring, the IF signal or the base band signal and the RF signal may be electrically isolated.

Referring to FIG. 9B, an antenna apparatus according to an embodiment of the present disclosure may include at least a portion of a shielding member 360, a connector 420, and a chip end-fire antenna 430.

The shielding member 360 may be disposed below a connection member 200 to confine an IC 310 together with the connection member 200. For example, the shielding member 360 may be arranged to cover the IC 310 and a passive component 350 together (e.g., a conformal shield) or to cover each of the IC 310 and the passive component 350 (e.g., a compartment shield). For example, the shielding member 360 may have a shape of a hexahedron having one surface open, and may have a hexahedral receiving space through coupling with the connection member 200. The shielding member 360 may be made of a material having high conductivity such as copper to have a short skin depth, and may be electrically connected to a ground plane of the connection member 200. Therefore, the shielding member 360 may reduce electromagnetic noise that may be received by the IC 310 and the passive component 350.

The connector 420 may have a connection structure of a cable (e.g., a coaxial cable, a flexible PCB), may be electrically connected to an IC ground plane of the connection member 200, and may have a role similar to that of the sub-substrate 410 described above. For example, the connector 420 may receive an IF signal, a base band signal and/or a power from a cable, or provide an IF signal and/or a base band signal to a cable.

The chip end-fire antenna 430 may transmit or receive an RF signal in support of an antenna apparatus, according to an embodiment of the present disclosure. For example, the chip end-fire antenna 430 may include a dielectric block having a dielectric constant greater than that of an insulating layer, and a plurality of electrodes disposed on both surfaces of the dielectric block. One of the plurality of electrodes may be electrically connected to the wiring of the connection member 200, and another of the plurality of electrodes may be electrically connected to the ground plane of the connection member 200.

Figure 10A:
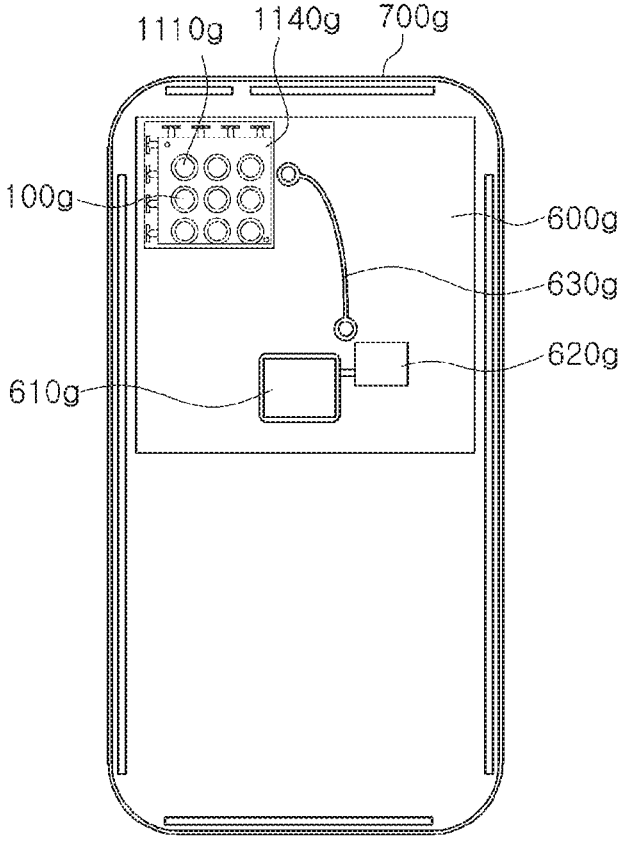
FIGS. 10A and 10B are plan views illustrating an arrangement of antenna apparatuses according to embodiments of the present disclosure, in an electronic device.
Figure 10B:
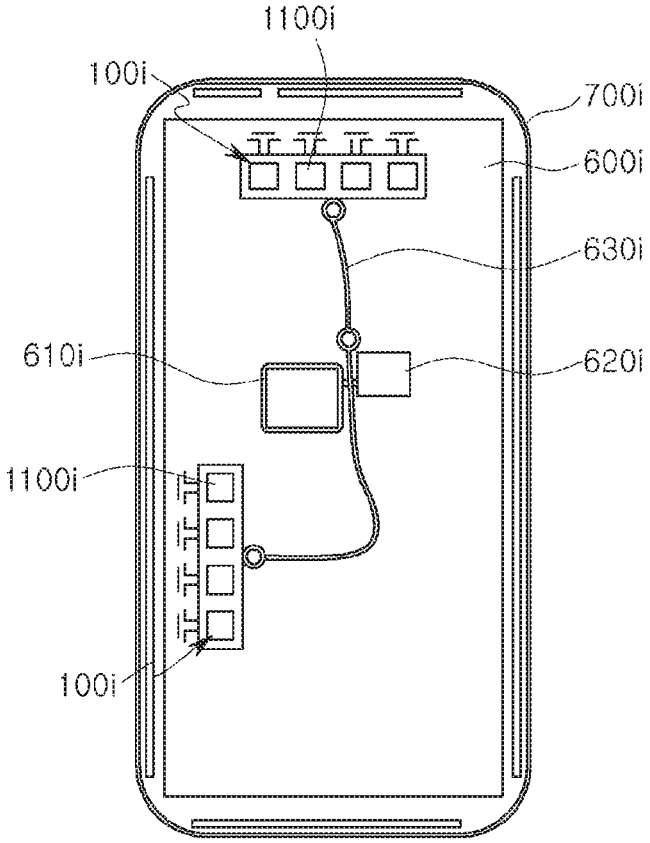

FIGS. 10A and 10B are plan views illustrating arrangements of antenna apparatuses according to embodiments of the present disclosure, in electronic devices.

Referring to FIG. 10A, an antenna apparatus 100*g* including a patch antenna pattern 1110*g* and a dielectric layer 1140*g* may be disposed adjacent to a lateral boundary of an electronic device 700*g* on a set substrate 600*g* of the electronic device 700*g*.

The electronic device 700*g* may be a smartphone, a personal digital assistant, a digital video camera, a digital still camera, a network system, a computer, a monitor, a tablet, a laptop, a netbook, a television, a video game, a smart watch, an automotive, or the like, but is not limited to such devices.

A communications module 610*g* and a base band circuit 620*g* may also be arranged on the set substrate 600*g*. The antenna apparatus 100*g* may be electrically connected to the communications module 610*g* and/or the base band circuit 620*g* through a coaxial cable 630*g*.

The communications module 610*g* may include at least a portion of: a memory chip, such as a volatile memory (e.g., a DRAM), a non-volatile memory (e.g., a ROM), a flash memory, or the like; an application processor chip, such as a central processor (e.g., a CPU), a graphics processor (e.g., a GPU), a digital signal processor, a cryptographic processor, a microprocessor, a microcontroller, or the like; and a logic chip, such as an analog-to-digital converter, an application-specific IC (ASIC), or the like, to perform a digital signal process.

The base band circuit 620*g* may perform an analog-to-digital conversion, amplification in response to an analog signal, filtering, and frequency conversion, to generate a base signal. The base signal input/output from the base band circuit 620*g* may be transferred to the antenna apparatus 100*g* through a cable.

For example, the base signal may be transmitted to the IC through an electrical connection structure, a core via, and a wiring. The IC may convert the base signal into an RF signal in a millimeter wave (mmWave) band.

Referring to FIG. 10B, a plurality of antenna apparatuses 100*i* each including a patch antenna pattern 1110*i* may be respectively disposed adjacent to centers of sides of an electronic device 700*i*, which has a polygonal shape, on a set substrate 600*i* of the electronic device 700*i*. A communications module 610*i* and a base band circuit 620*i* may also be arranged on the set substrate 600*i*. The antenna apparatuses may be electrically connected to the communications module 610*i* and/or the base band circuit 620*i* through a coaxial cable 630*i*.

The pattern, via, and plane disclosed herein may include a metal material (e.g., a conductive material, such as copper (Cu), aluminum (Al), silver (Ag), tin (Sn), gold (Au), nickel (Ni), lead (Pb), titanium (Ti), alloys thereof, or the like), and may be formed according by plating methods such as a chemical vapor deposition (CVD) process, a physical vapor deposition (PVD) process, a sputtering process, a subtractive process, an additive process, a semi-additive process (SAP), a modified semi-additive process (MSAP), and or the like, but are not limited thereto.

The dielectric and insulating layers disclosed herein may be implemented with a thermosetting resin such as FR4, liquid crystal polymer (LCP), low temperature co-fired ceramic (LTCC), an epoxy resin, or a thermoplastic resin such as polyimide, or a resin impregnated into core materials such as glass fiber, glass cloth, and glass fabric together with inorganic filler, prepregs, Ajinomoto build-up film (ABF), FR-4, bismaleimide triazine (BT), a photoimageable dielectric (PID) resin, a copper clad laminate (CCL), a glass or ceramic based insulating material, or the like.

RF signals disclosed herein may have a format according to W-Fi (IEEE 802.11 family, etc.), WiMAX (IEEE 802.16 family, etc.), IEEE 802.20, long term evolution (LTE), Ev-DO, HSPA+, HSDPA+, HSUPA+, EDGE, GSM, GPS, GPRS, CDMA, TDMA, DECT, Bluetooth, 3G, 4G, 5G, and any other wireless and wired protocols designated later thereto, but are not limited thereto.

An antenna apparatus according to the examples disclosed herein may improve or easily downsize antenna performance (e.g., gain, bandwidth, etc.).

While specific examples have been shown and described above, it will be apparent after an understanding of this disclosure that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna apparatus comprising:

a ground plane;

a patch antenna pattern disposed on an upper surface of the ground plane;

a feed via penetrating the ground plane and spaced apart from the patch antenna pattern; and a coiled feed pattern electrically connected to an upper end of the feed via, spaced apart from the patch antenna pattern, and configured to provide a feed path to the patch antenna pattern, wherein at least a portion of the coiled feed pattern is coiled, wherein the patch antenna pattern comprises an aperture portion corresponding to the coiled feed pattern, and the aperture portion comprises:

at least one aperture via, the at least one first aperture via having a first end electrically connected to a first patch antenna pattern of the patch antenna pattern; and an aperture pattern electrically connected to a second end of the at least one aperture via.

2. The antenna apparatus according to claim 1, wherein the patch antenna pattern comprises a recessed shape in a portion in which the aperture portion is located.

3. The antenna apparatus according to claim 2, wherein the aperture pattern is disposed below the patch antenna pattern and at least partially overlapping a recessed portion of the patch antenna pattern in a vertical direction.

4. The antenna apparatus according to claim 1, wherein the aperture pattern is disposed below the patch antenna pattern, and wherein the at least a portion of the coiled feed pattern is disposed on a level between the aperture pattern and the patch antenna pattern.

5. The antenna apparatus according to claim 1, wherein the patch antenna pattern comprises a polygonal shape, and wherein the aperture portion comprises a plurality of aperture portions respectively arranged on a plurality of sides of the polygonal shape.

6. The antenna apparatus according to claim 1, wherein the coiled feed pattern comprises:

a first coiled feed pattern comprising one end electrically connected to the feed via;

an inductive via comprising one end electrically connected to another end of the first coiled feed pattern; and a second coiled feed pattern comprising one end electrically connected to another end of the inductive via and disposed to at least partially overlap the first coiled feed pattern in a vertical direction.

7. The antenna apparatus according to claim 6, wherein a portion of the second coiled feed pattern extends in different directions from one end of a coiled portion of the second coiled feed pattern.

8. The antenna apparatus according to claim 1, wherein the patch antenna pattern comprises the first patch antenna pattern comprising the aperture portion, and a second patch antenna pattern disposed on the first patch antenna pattern at least partially overlapping the first patch antenna pattern in a vertical direction, and wherein the feed via comprises a first feed via electrically connected to the coiled feed pattern, and a second feed via spaced apart from the first feed via, penetrating the first patch antenna pattern, and electrically connected to the second patch antenna pattern.

9. The antenna apparatus according to claim 8, wherein the second feed via comprises a plurality of second feed vias respectively biased in different directions from a center of the second patch antenna pattern, wherein the plurality of second feed vias comprise portions extending parallel to the first and second patch antenna patterns between the first and second patch antenna patterns in different directions, and wherein lengths of the extending portions of the plurality of second feed vias between the first and second patch antenna patterns are different.

10. The antenna apparatus according to claim 8, further comprising a plurality of ground vias electrically connecting between the first patch antenna pattern and the ground plane, respectively.

11. The antenna apparatus according to claim 10, wherein the plurality of ground vias partially extend between the first patch antenna pattern and the ground plane in a direction, parallel to the first patch antenna pattern, respectively.

12. The antenna apparatus according to claim 8, wherein the second feed via partially extends between the first patch antenna pattern and the ground plane in a direction, parallel to the first patch antenna pattern.

13. The antenna apparatus according to claim 1, wherein the aperture portion is disposed to be biased from a center of the patch antenna pattern in an oblique direction with respect to respective sides of the upper surface of the ground plane, wherein a direction of the feed via spaced apart from the patch antenna pattern is the oblique direction with respect to respective sides of the upper surface of the ground plane.

14. The antenna apparatus according to claim 13, wherein the aperture portion is provided as a plurality of aperture portions arranged in oblique different directions from the center of the patch antenna pattern, the coiled feed pattern is provided as a plurality of coiled feed patterns spaced apart from each other and corresponding to the plurality of aperture portions, and the feed via includes a plurality of first feed vias electrically connected to a corresponding coiled feed pattern, among the plurality of coiled feed patterns.

15. The antenna apparatus according to claim 14, further comprising a plurality of extended patch antenna patterns at least partially overlapping a corresponding coiled feed pattern in the vertical direction, among the plurality of coiled feed patterns, respectively, wherein the plurality of extended patch antenna patterns have a wider shape closer to the patch antenna pattern.

16. An antenna apparatus comprising:

a ground plane;

a patch antenna pattern disposed on an upper surface of the ground plane;

a feed via penetrating the ground plane and spaced apart from the patch antenna pattern; and a coiled feed pattern electrically connected to an upper end of the feed via, spaced apart from the patch antenna pattern, and configured to provide a feed path to the patch antenna pattern, wherein at least a portion of the coiled feed pattern is coiled, wherein the patch antenna pattern comprises an aperture portion corresponding to the coiled feed pattern, and wherein the aperture portion comprises an aperture pattern disposed below the patch antenna pattern and at least partially overlapping a recessed portion of the patch antenna pattern in a vertical direction.

17. An antenna apparatus comprising:

a ground plane;

a patch antenna pattern disposed on an upper surface of the ground plane;

a feed via penetrating the ground plane and spaced apart from the patch antenna pattern; and a coiled feed pattern electrically connected to an upper end of the feed via, spaced apart from the patch antenna pattern, and configured to provide a feed path to the patch antenna pattern, wherein at least a portion of the coiled feed pattern is coiled, wherein the patch antenna pattern comprises an aperture portion corresponding to the coiled feed pattern, wherein the patch antenna pattern comprises a polygonal shape, and wherein the aperture portion comprises a plurality of aperture portions respectively arranged on a plurality of sides of the polygonal shape.

* * * * *